US009086675B2

(12) United States Patent
Okabe

(10) Patent No.: US 9,086,675 B2
(45) Date of Patent: Jul. 21, 2015

(54) IMAGE FORMING DEVICE WITH CARTRIDGE SUPPORT MEMBER SUPPORTING A PLURALITY OF CARTRIDGES

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 574 days.

(21) Appl. No.: 13/346,771

(22) Filed: Jan. 10, 2012

(65) Prior Publication Data

US 2012/0243903 A1 Sep. 27, 2012

(30) Foreign Application Priority Data

Mar. 23, 2011 (JP) ..... 2011-063691

(51) Int. Cl.
*G03G 15/00* (2006.01)
*G03G 21/18* (2006.01)
*G03G 21/16* (2006.01)

(52) U.S. Cl.
CPC .... *G03G 21/1633* (2013.01); *G03G 2215/0148* (2013.01); *G03G 2221/1684* (2013.01)

(58) Field of Classification Search
CPC ..... G03G 21/1633; G03G 2221/1684; G03G 2215/0148
USPC ..... 399/110, 111
See application file for complete search history.

(56) References Cited

U.S. PATENT DOCUMENTS 776,736 A * 12/1904 Greenen ..... 312/323
3,439,967 A * 4/1969 Taylor ..... 312/307
3,519,319 A * 7/1970 Taylor ..... 312/246
3,722,975 A * 3/1973 Taylor ..... 312/334.44
3,980,363 A * 9/1976 Dean et al. ..... 312/294
4,314,734 A * 2/1982 Grunert ..... 312/322
4,792,195 A * 12/1988 Adriaansen et al. ..... 312/245

(Continued)

FOREIGN PATENT DOCUMENTS

JP S59-182087 U 12/1984
JP 2005-107139 4/2005

(Continued)

OTHER PUBLICATIONS

JP Office Action mailed Mar. 12, 2013, JP Appln. 2011-063691, English translation.

*Primary Examiner* — David Bolduc
(74) *Attorney, Agent, or Firm* — Banner & Witcoff, Ltd.

(57) ABSTRACT

An image forming device includes a main casing and a cartridge support member. The main casing provides a fulcrum part. The cartridge support member supports a plurality of cartridges and is movable among an internal position in which the cartridge support member is accommodated in the main casing, an external position in which the cartridge support member is pulled outside the main casing, and a cartridge mounting position. The cartridge support member is slidable in a pulled-out direction from the internal position to the external position, and is pivotable between the external position and the cartridge mounting position. The cartridge support member has an upstream portion and a downstream portion disposed downstream of the upstream portion in the pulled-out direction. The cartridge support member pivots about the fulcrum part positioned near the upstream portion when the cartridge support member moves from the external position to the cartridge mounting position.

16 Claims, 25 Drawing Sheets

(d)

(56) References Cited

U.S. PATENT DOCUMENTS

| | | | | |
|---|---|---|---|---|
| 5,244,272 | A * | 9/1993 | Thompson | 312/334.23 |
| 5,399,006 | A * | 3/1995 | Murazumi | 312/109 |
| 7,907,868 | B2 | 3/2011 | Igarashi et al. | |
| 7,963,408 | B2 * | 6/2011 | Glover | 211/126.15 |
| 8,010,014 | B2 | 8/2011 | Noguchi | |
| 8,200,119 | B2 | 6/2012 | Okabe et al. | |
| 8,346,124 | B2 | 1/2013 | Igarashi et al. | |
| 2006/0251446 | A1 | 11/2006 | Okabe et al. | |
| 2007/0071494 | A1 | 3/2007 | Igarashi et al. | |
| 2007/0077087 | A1 * | 4/2007 | Okabe et al. | 399/111 |
| 2008/0219696 | A1 * | 9/2008 | Itabashi | 399/114 |
| 2009/0317127 | A1 * | 12/2009 | Kishi | 399/110 |
| 2010/0080617 | A1 | 4/2010 | Noguchi | |
| 2010/0135693 | A1 | 6/2010 | Okabe et al. | |
| 2011/0262181 | A1 | 10/2011 | Noguchi | |
| 2012/0008977 | A1 | 1/2012 | Igarashi et al. | |
| 2012/0321344 | A1 | 12/2012 | Noguchi | |

FOREIGN PATENT DOCUMENTS

| | | |
|---|---|---|
| JP | 2006-276726 | 10/2006 |
| JP | 2007-121983 A | 5/2007 |
| JP | 2010-102321 A | 5/2010 |
| JP | 2010-128336 | 6/2010 |

* cited by examiner

IMAGE FORMING DEVICE WITH CARTRIDGE SUPPORT MEMBER SUPPORTING A PLURALITY OF CARTRIDGES

CROSS REFERENCE TO RELATED APPLICATION

This application claims priority from Japanese Patent Application No. 2011-063691 filed Mar. 23, 2011. The entire content of the priority application is incorporated herein by reference.

TECHNICAL FIELD

The present invention relates to an image forming device.

BACKGROUND

One image-forming device well known in the art is a color laser printer having a plurality of cartridges arranged parallel to one another and juxtaposed in a prescribed direction, and a support member for supporting the plurality of cartridges. In this color laser printer, the support member can be pulled out of the printer body. Once the support member has been pulled out of the body, cartridges can be mounted in or removed from the support member.

SUMMARY

Some of these types of printers are designed so that the user pulls the support member out of the printer body along an upper slope to the horizontal. However, with this design, the downstream end of the support member in the pulling direction is higher than the upstream end, making the operation of replacing cartridges more difficult.

In view of the foregoing, it is an object of the present invention to provide an image-forming device in which the support member is pulled out along an upward slope to the horizontal, but that is capable of facilitating the user in replacing cartridges.

In order to attain the above and other objects, the invention provides an image forming device including a main casing and a cartridge support member. The main casing provides a fulcrum part. The cartridge support member is configured to support a plurality of cartridges and movable among an internal position in which the cartridge support member is accommodated in the main casing, an external position in which the cartridge support member is pulled outside the main casing, and a cartridge mounting position. The cartridge support member is slidable in a pulled-out direction from the internal position to the external direction. The cartridge support member is pivotable between the external position and the cartridge mounting position. The cartridge support member has an upstream portion and a downstream portion disposed downstream of the upstream portion in the pulled-out direction. The cartridge support member pivots about the fulcrum part positioned near the upstream portion when the cartridge support member moves from the external position to the cartridge mounting position.

BRIEF DESCRIPTION OF THE DRAWINGS

The particular features and advantages of the invention as well as other objects will become apparent from the following description taken in connection with the accompanying drawings, in which:

FIG. 4(*b*) is a schematic cross-sectional view showing the printer according to the first embodiment when the cartridge support member is disposed in an external position;

FIG. 4(*c*) is a schematic cross-sectional view showing the printer according to the first embodiment when the cartridge support member is disposed in a cartridge mounting position;

FIG. 4(*d*) is a schematic cross-sectional view showing how cartridges are mounted in and removed from the cartridge support member when the cartridge support member is disposed in the cartridge mounting position in the first embodiment;

FIG. 5(*b*) is a schematic cross-sectional view showing the printer according to the second embodiment when the cartridge support member is disposed in an external position;

FIG. 5(*c*) is a schematic cross-sectional view showing the printer according to the second embodiment when the cartridge support member is disposed in a cartridge mounting position;

FIG. 5(*d*) is a schematic cross-sectional view showing how cartridges are mounted in and removed from the cartridge support member when the cartridge support member is disposed in the cartridge mounting position in the second embodiment;

FIG. 5(*e*) is a schematic cross-sectional view showing how the cartridge support member is removed from a main casing of the printer according to the second embodiment;

FIG. 6(*b*) is a schematic cross-sectional view showing the printer according to the third embodiment when the cartridge support member is disposed in an external position;

FIG. 6(*c*) is a schematic cross-sectional view showing the printer according to the third embodiment when the cartridge support member is disposed in a cartridge mounting position;

FIG. 7(*b*) is a schematic cross-sectional view showing the printer according to the fourth embodiment when the cartridge support member is disposed in an external position;

FIG. 7(*c*) is a schematic cross-sectional view showing the printer according to the fourth embodiment when the cartridge support member is disposed in a cartridge mounting position;

FIG. 8(*b*) is a schematic cross-sectional view showing the printer according to the fifth embodiment when the cartridge support member is disposed in an external position;

FIG. 8(*c*) is a schematic cross-sectional view showing the printer according to the fifth embodiment when the cartridge support member is disposed in a cartridge mounting position;

FIG. 9(*b*) is a schematic cross-sectional view showing the printer according to the sixth embodiment when the cartridge support member is disposed in an external position;

FIG. 9(*c*) is a schematic cross-sectional view showing the printer according to the sixth embodiment when the cartridge support member is disposed in a cartridge mounting position; and FIG. 9(*d*) is a schematic cross-sectional view showing how cartridges are mounted in and removed from the cartridge support member when the cartridge support member is disposed in the cartridge mounting position in the sixth embodiment.

DETAILED DESCRIPTION

Figure 1:
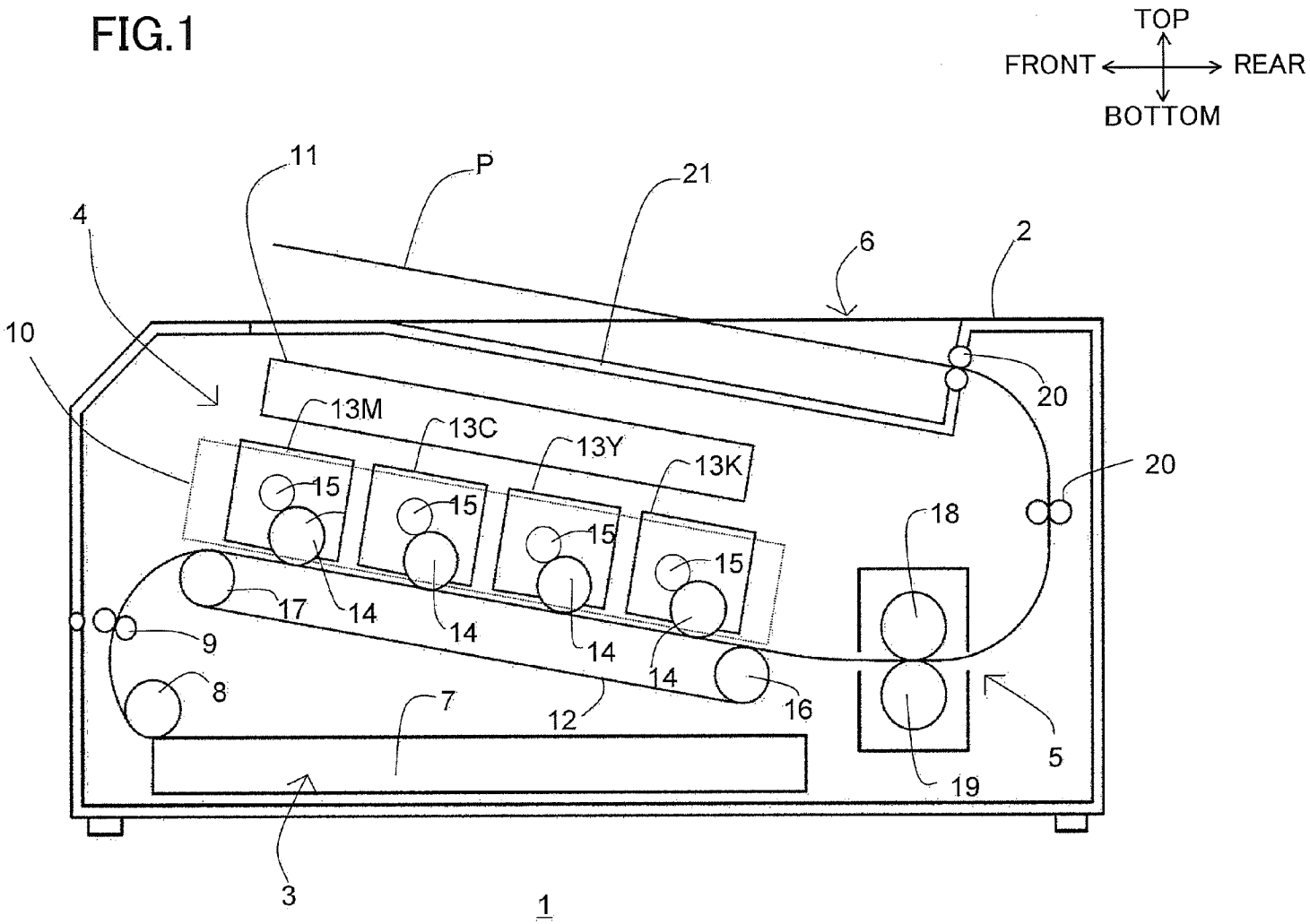
FIG. 1 is a schematic cross-sectional view of a printer according to a first embodiment of the present invention.

An image forming device according to embodiments of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that a printer 1 is disposed in an orientation in which it is intended to be used. In use, the printer 1 is disposed as shown in FIG. 1. Specifically, a left side of FIG. 1 will be referred to as a front side, and a right side in FIG. 1 will be referred to as a rear side. A far side in FIG. 1 will be referred to as a right side, and a near side in FIG. 1 will be referred to as a left side.

Figure 2:
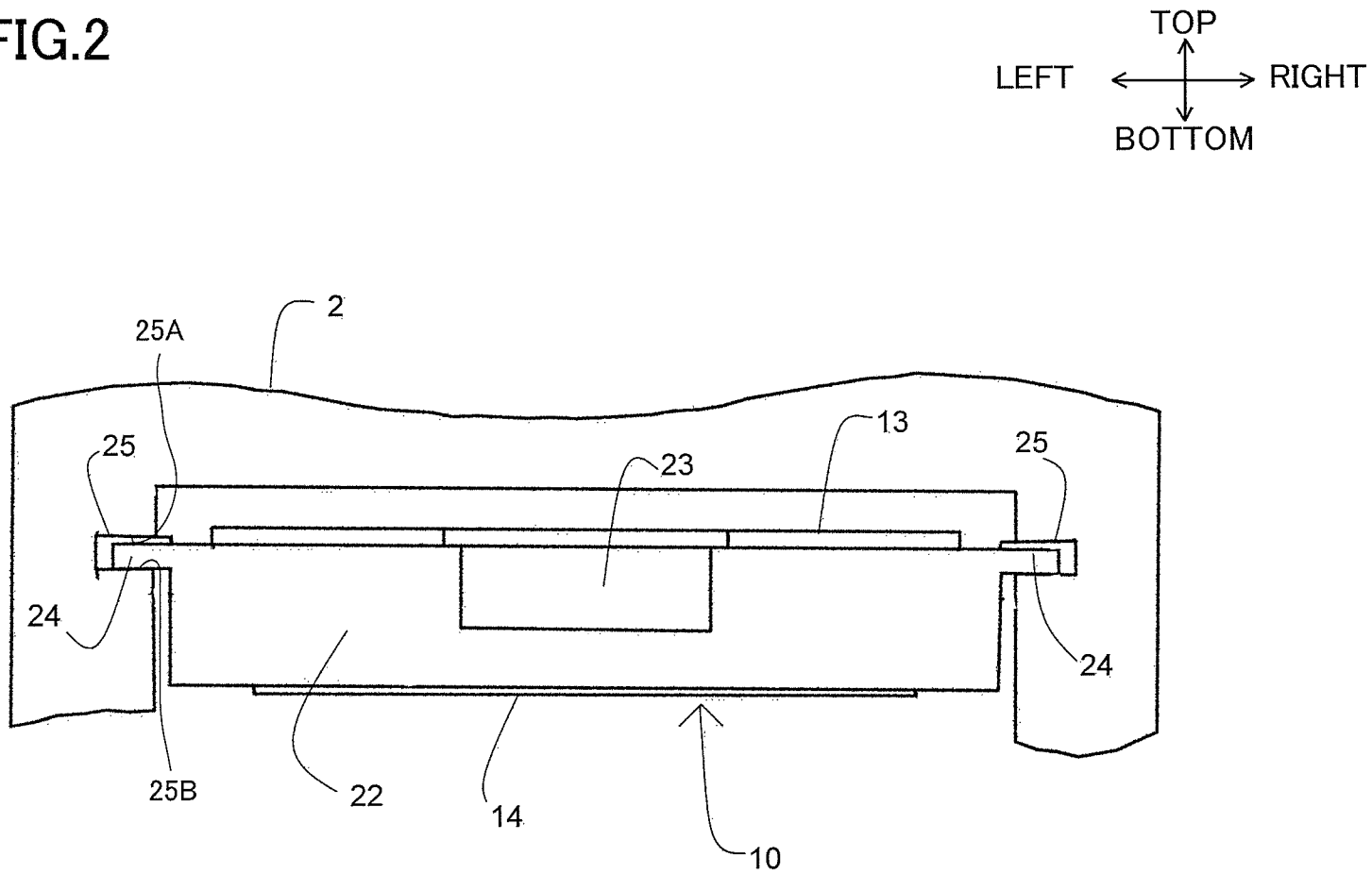
FIG. 2 is a schematic front view of a part of the printer showing a portion near a cartridge support member according to the first embodiment.

As shown in FIG. 1, the printer 1 includes a main casing 2 and, within the main casing 2, a sheet-feeding unit 3 for supplying sheets of a paper P to be printed, an image-forming unit 4 for forming images on the sheets of paper P supplied by the sheet-feeding unit 3, a fixing unit 5 for fixing toner images formed on the paper P by the image-forming unit 4, and a discharge unit 6 for discharging the paper P from the main casing 2. The main casing 2 has guide parts 25 for guiding and supporting sliding parts 24 (FIG. 2.)

The sheet-feeding unit 3 is provided in the bottom section of the printer and includes a paper cassette 7 accommodating sheets of paper P, and a pickup roller 8 for picking up and feeding sheets of paper P from the paper cassette 7 one sheet at a time. When the pickup roller 8 feeds sheets of paper P from the paper cassette 7, conveying rollers 9 and the like downstream of the pickup roller 8 convey the sheets to the image-forming unit 4.

The image-forming unit 4 includes a cartridge support member 10, an exposure unit 11, a paper-conveying belt 12, and four process cartridges 13.

The cartridge support member 10 supports the four process cartridges 13. More specifically, the process cartridges 13 are arranged in the cartridge support member 10 from front to rear in the order of a magenta process cartridge 13M, a cyan process cartridge 13C, a yellow process cartridge 13Y, and a black process cartridge 13K. The process cartridges 13 accommodate toner in the respective colors magenta (M), cyan (C), yellow (Y), and black (K). Each process cartridge 13 includes a photosensitive drum 14, and a developing roller 15. The photosensitive drums 14 are generally cylindrically shaped members. The photosensitive drums 14 are rotatably supported in the corresponding process cartridges 13. The developing rollers 15 are also rotatably supported in the process cartridges 13 and are in contact with the tops of respective photosensitive drums 14.

The exposure unit 11 scans laser beams over the surfaces of the photosensitive drums 14 based on image data. When the surfaces of the photosensitive drums 14 are exposed by the laser beams, the surface potential in the exposed areas is reduced, forming electrostatic latent images on the surfaces of the photosensitive drums 14.

The paper-conveying belt 12 is arranged with a downward slope from front to rear. The paper-conveying belt 12 is an endless belt that circulates continuously while carrying sheets of paper P on its top surface. The paper-conveying belt 12 is looped around a drive roller 16 and a follow roller 17. When the drive roller 16 is driven to rotate, the paper-conveying belt 12 circulates so that its top surface on the side opposing the photosensitive drums 14 moves from front to rear. Accordingly, sheets of paper P carried on the top surface of the paper-conveying belt 12 are conveyed to the fixing unit 5.

The fixing unit 5 includes a heating roller 18, and a pressure roller 19. After the photosensitive drums 14 of the image-forming unit 4 have deposited toner images in the four colors on a sheet of paper P, the toner images are fixed to the sheet in the fixing unit 5 by heat and pressure applied by the heating roller 18 and pressure roller 19. The heating roller 18 and pressure roller 19 also convey the sheet toward the discharge unit 6.

The discharge unit 6 includes a plurality of discharge rollers 20, and a discharge tray 21. The discharge tray 21 is provided on the top surface of the printer 1. The discharge rollers 20 function to convey sheets of paper P from the fixing unit 5 onto the discharge tray 21.

2. Detailed Description of a Support Structure for the Cartridge Support Member As shown in FIG. 2, the cartridge support member 10 is supported on the guide parts 25 described later and can move relative to the main casing 2 along the guide parts 25. Specifically, the cartridge support member 10 can move among an internal position in which the cartridge support member 10 is accommodated in the main casing 2, an external position in which the cartridge support member 10 is pulled outside the main casing 2, and a cartridge mounting position in which process cartridges 13 can be mounted in and removed from the cartridge support member 10. To move to the cartridge mounting position, the cartridge support member 10 in the external position is pivoted about its rear end to rotate its front end downward. More specifically, the cartridge support member is pivotable about a fulcrum part 31 (described later) positioned near an upstream end portion 22A described later when the cartridge support member 10 moves from the external position to the cartridge mounting position.

The cartridge support member 10 has a cartridge housing case 22, a front grip 23, and a pair of left and right sliding parts 24.

Figure 3:
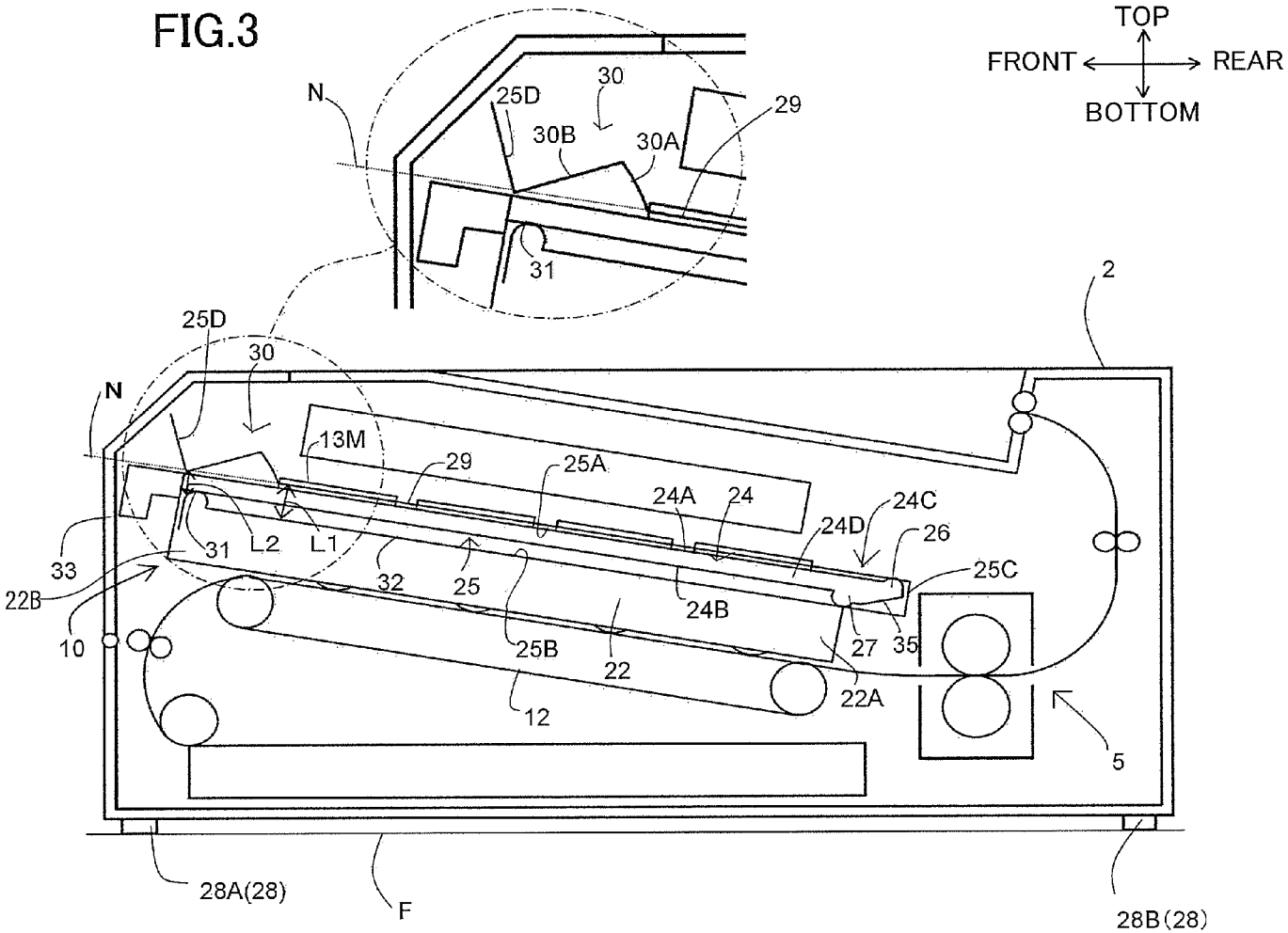
FIG. 3 is a schematic cross-sectional view of the printer when a cartridge support member is accommodated in the printer according to the first embodiment.
Figure 4A:
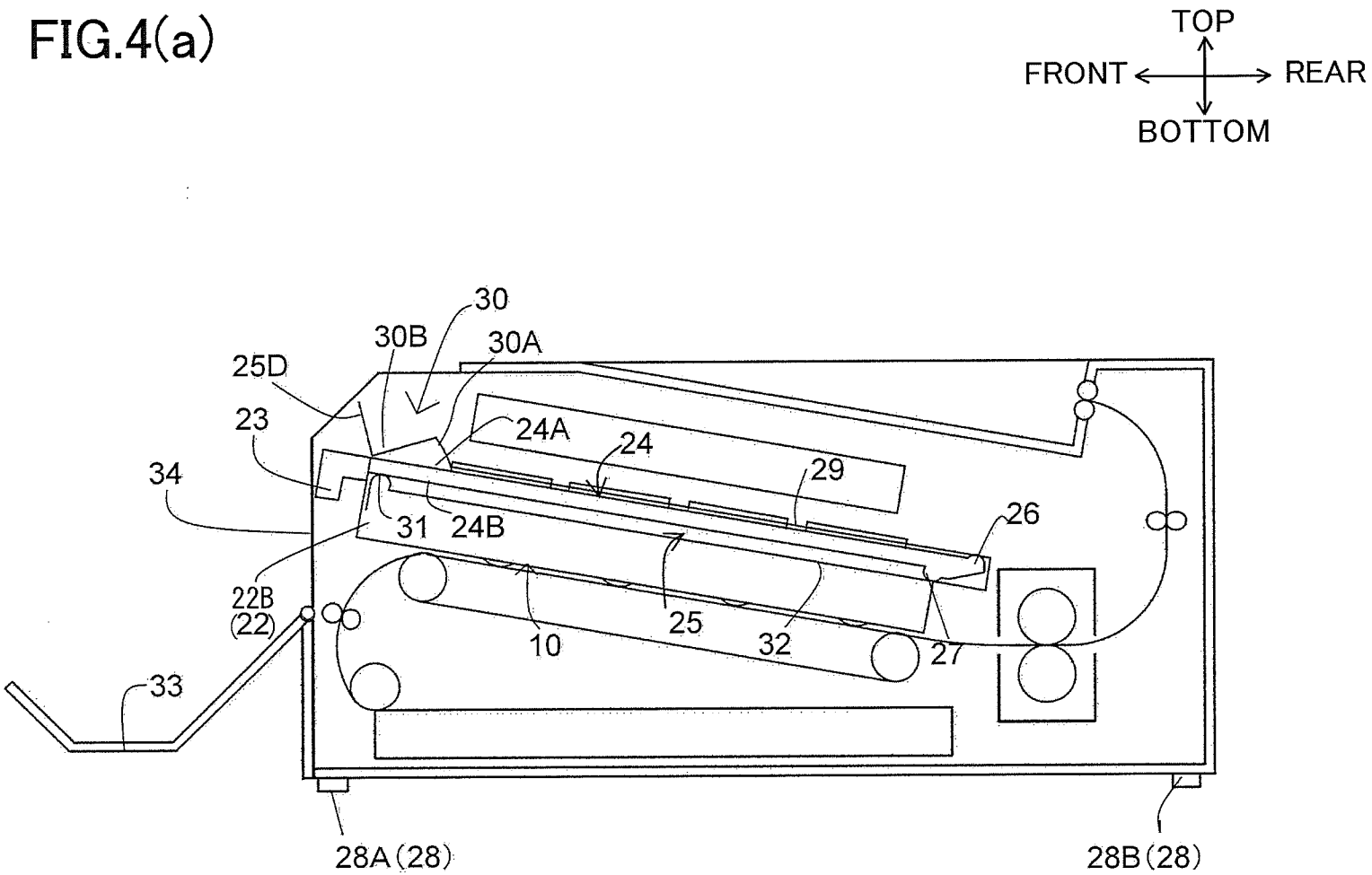
FIG. 4(*a*) is a schematic cross-sectional view showing the printer according to the first embodiment when the cartridge support member is disposed in an internal position.
Figure 4B:
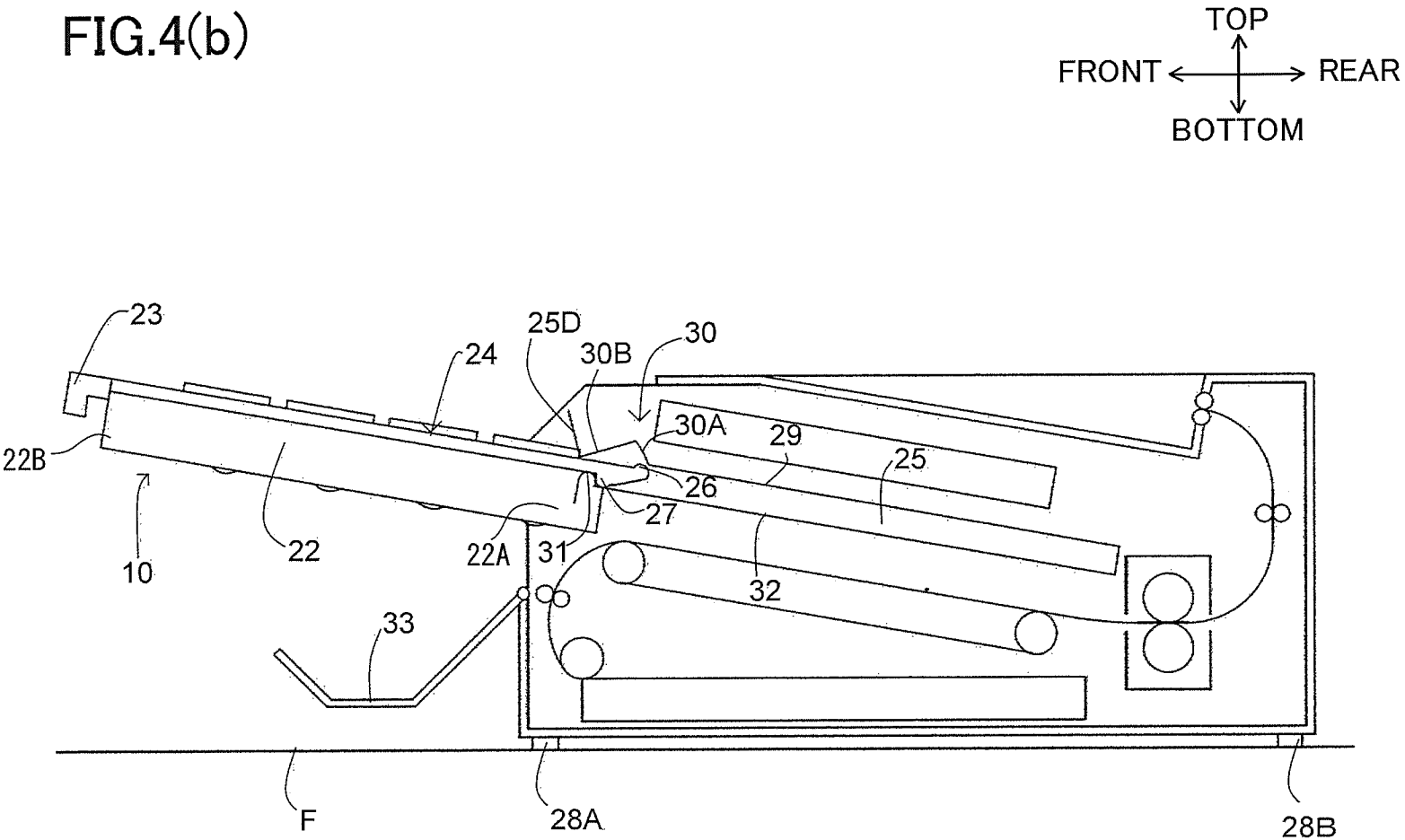
Figure 4C:
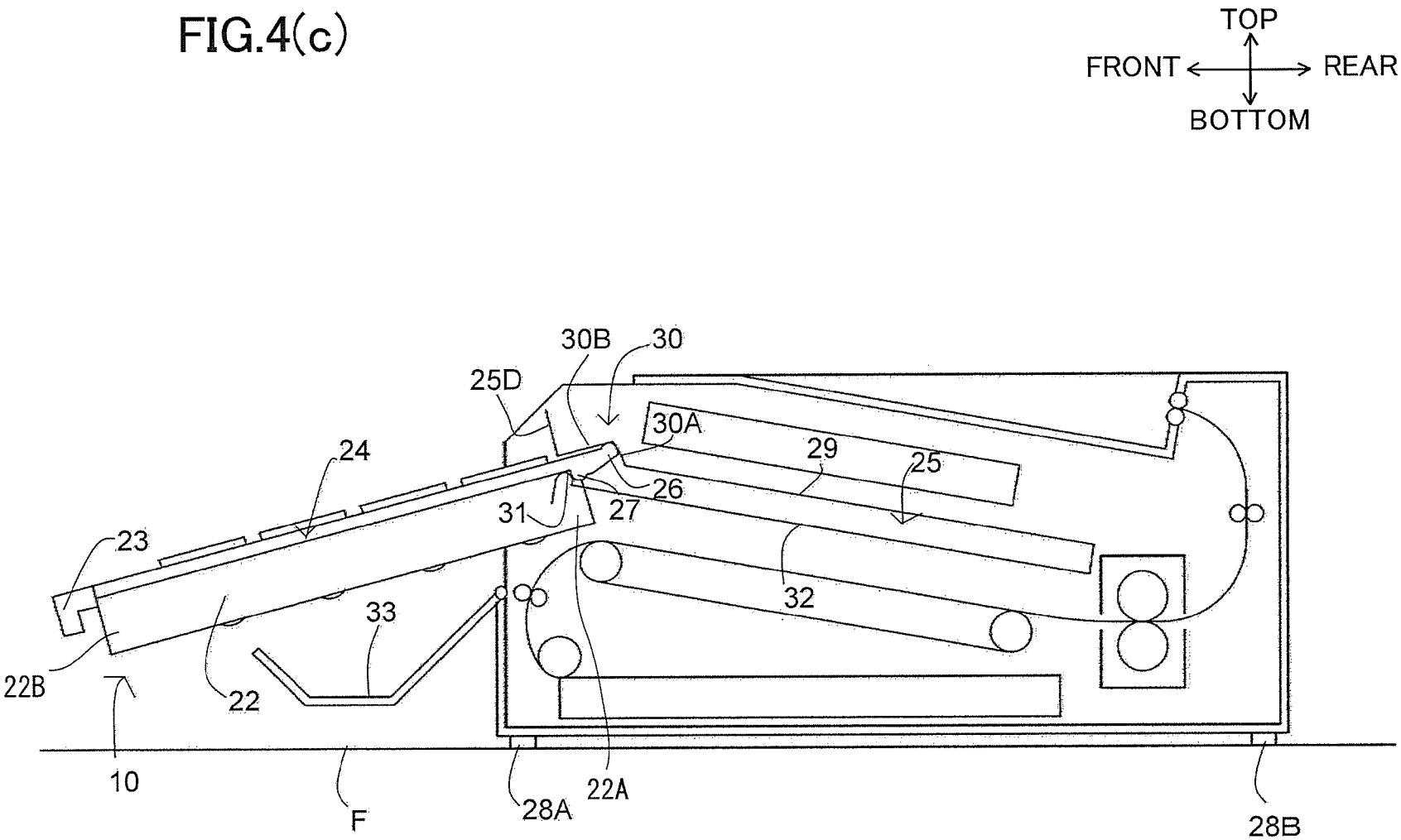
Figure 4D:
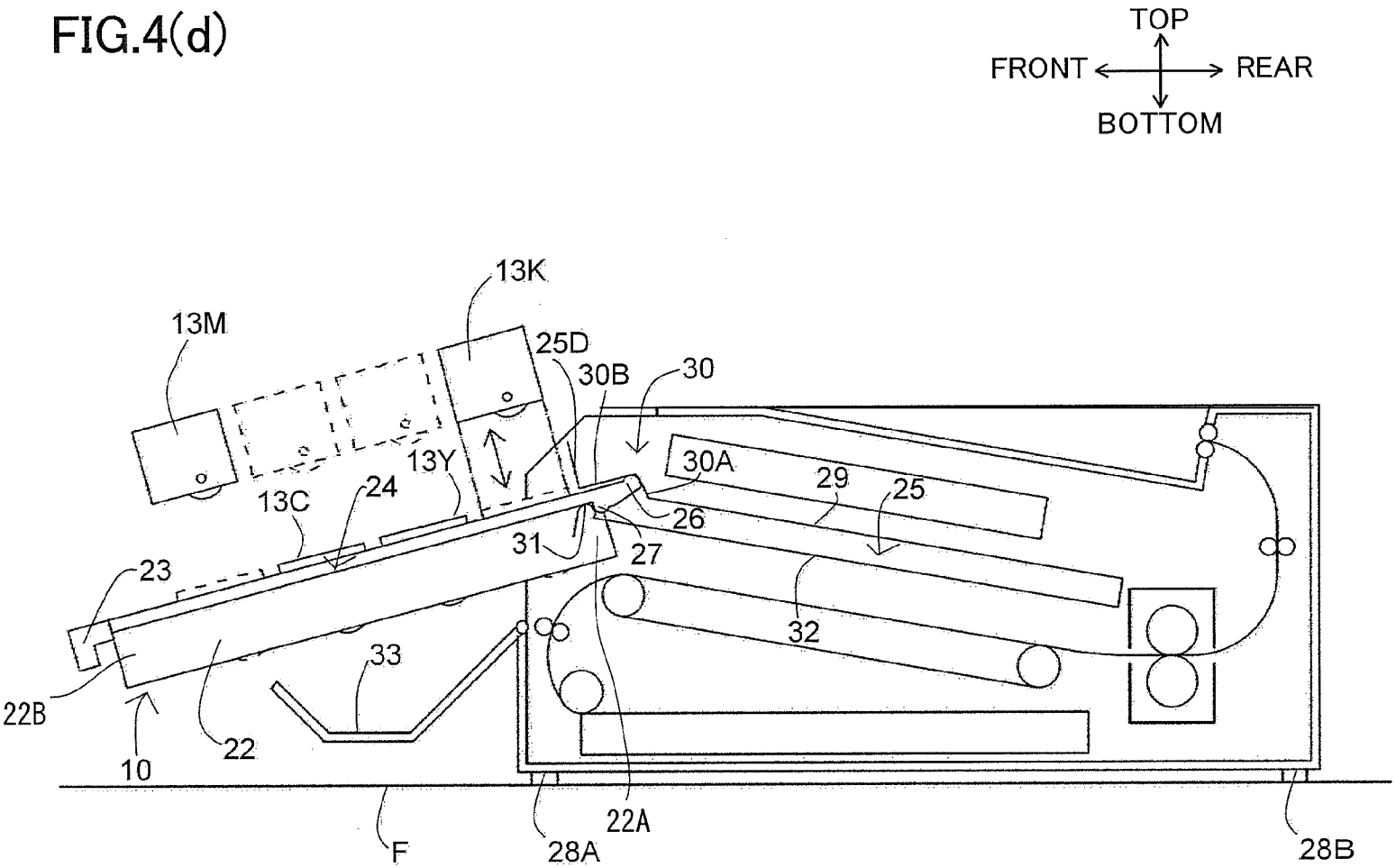
Figure 5A:
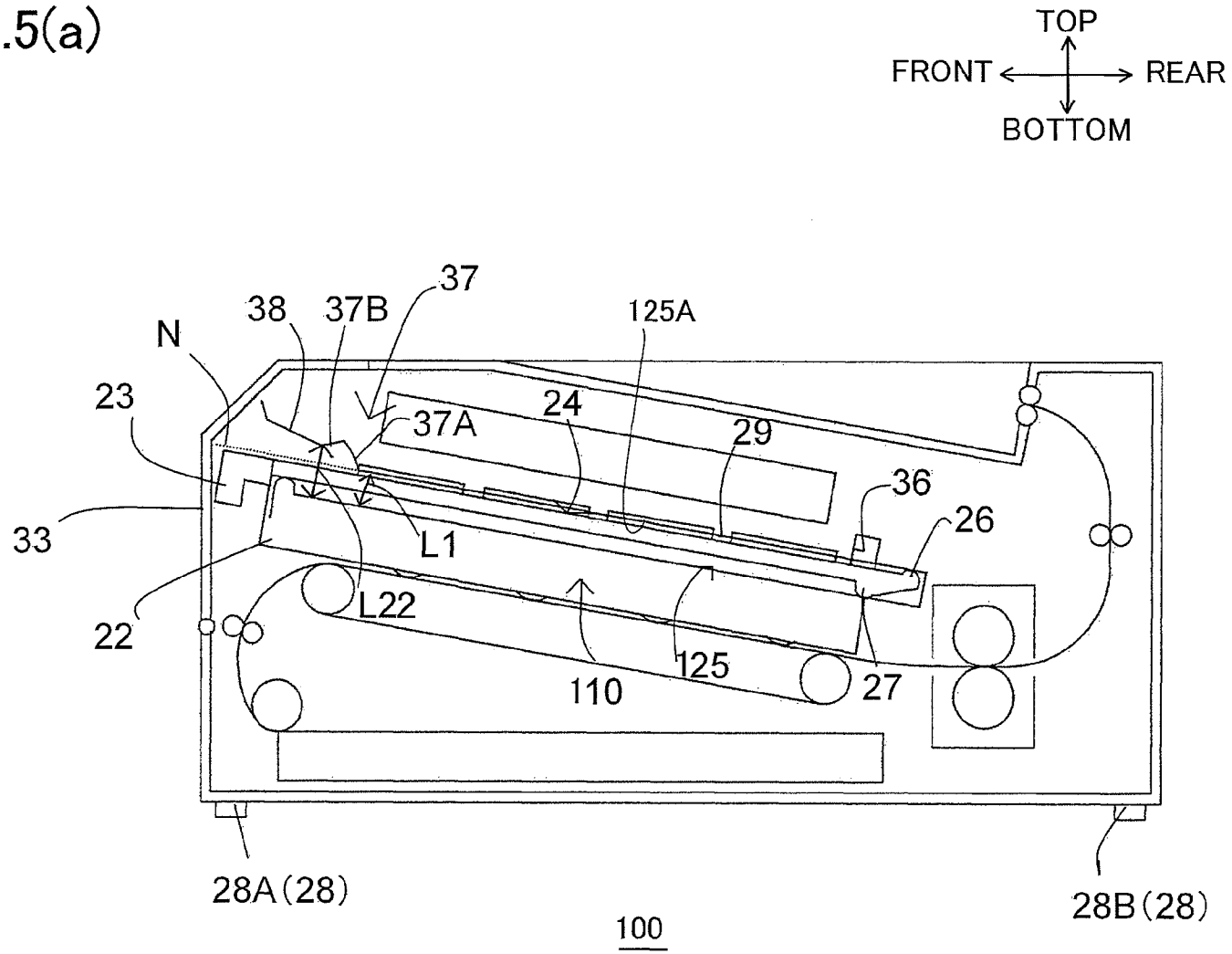
FIG. 5(*a*) is a schematic cross-sectional view showing a printer according to a second embodiment of the present invention when the cartridge support member is disposed in an internal position.
Figure 5B:
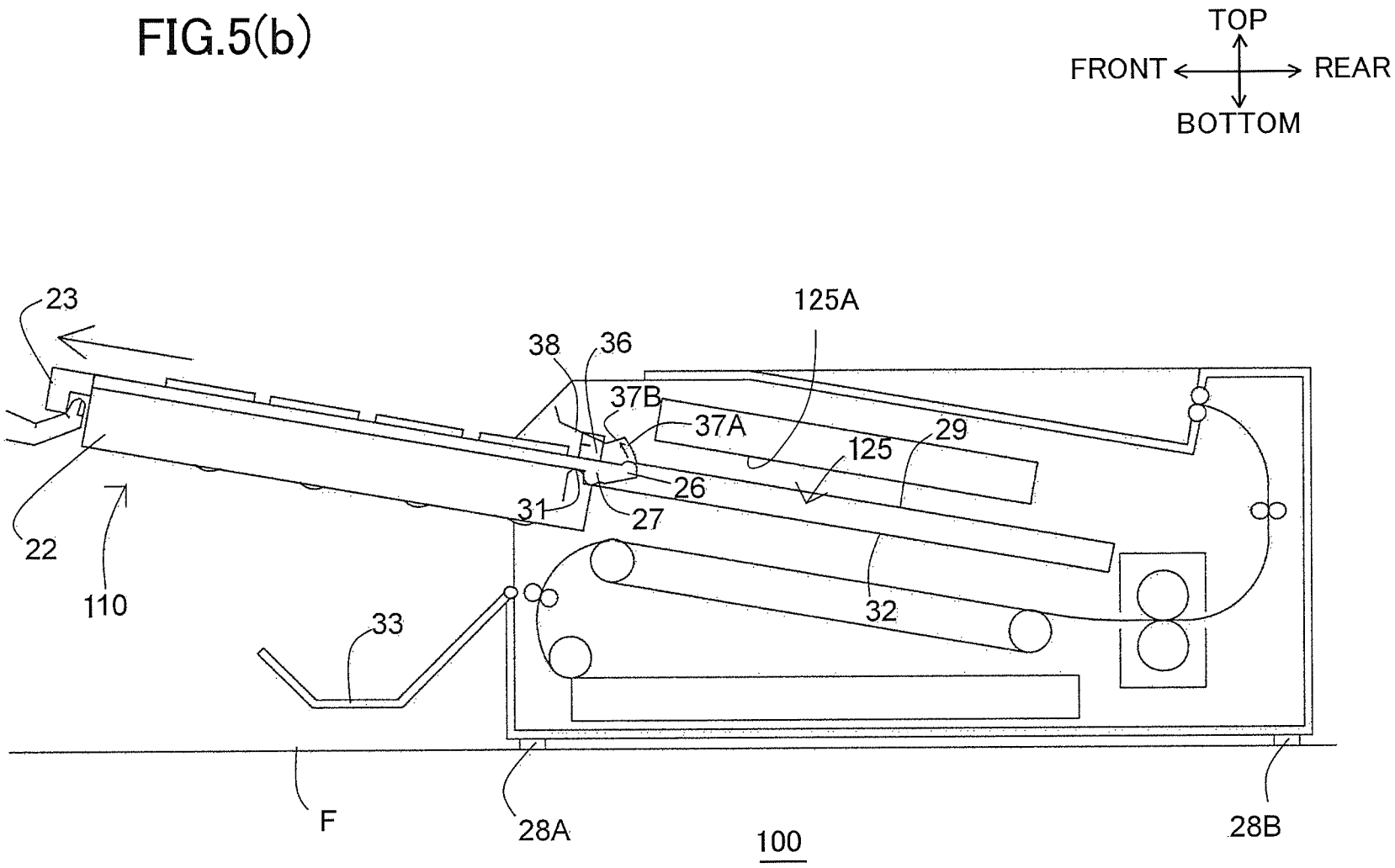
Figure 5C:
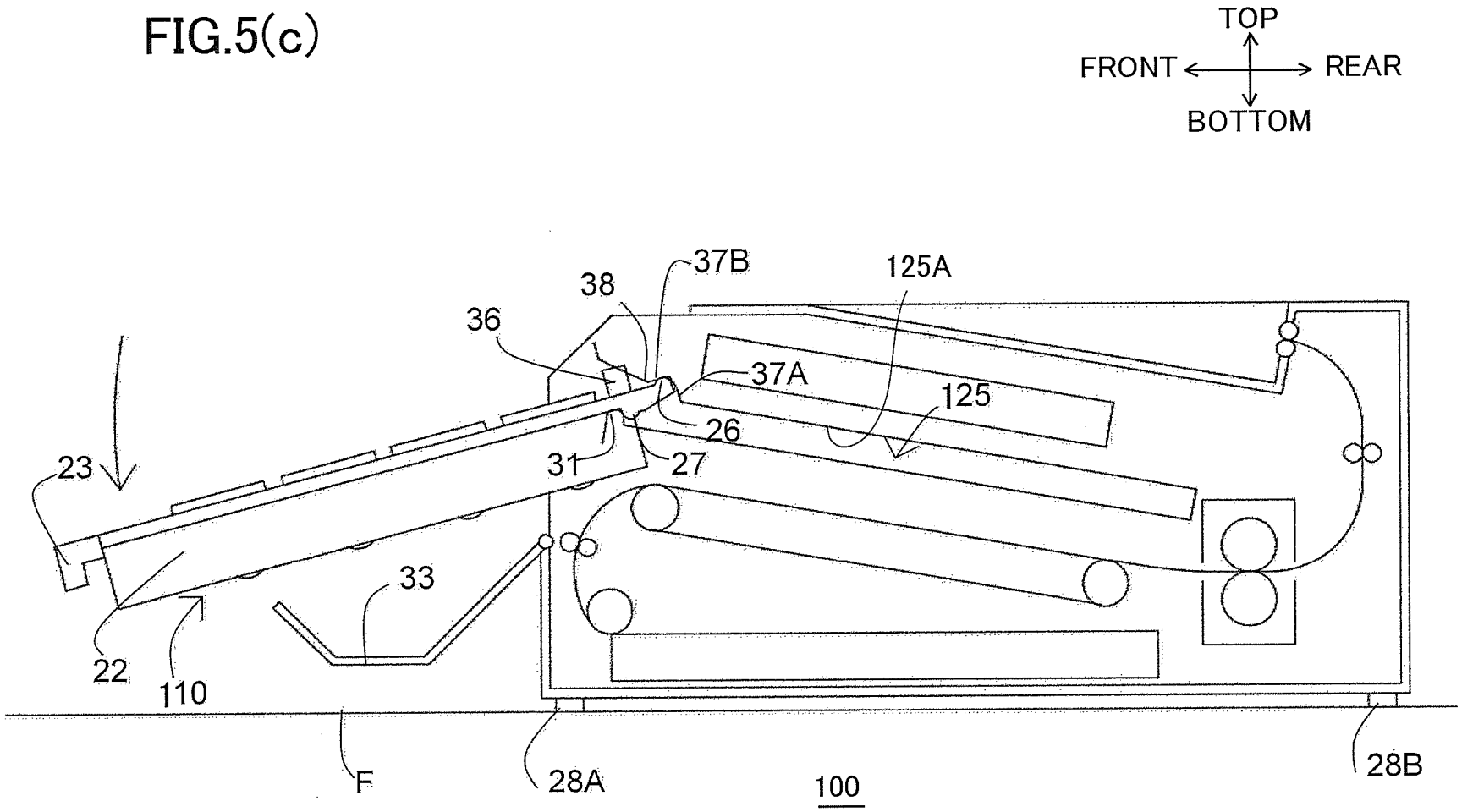
Figure 5D:
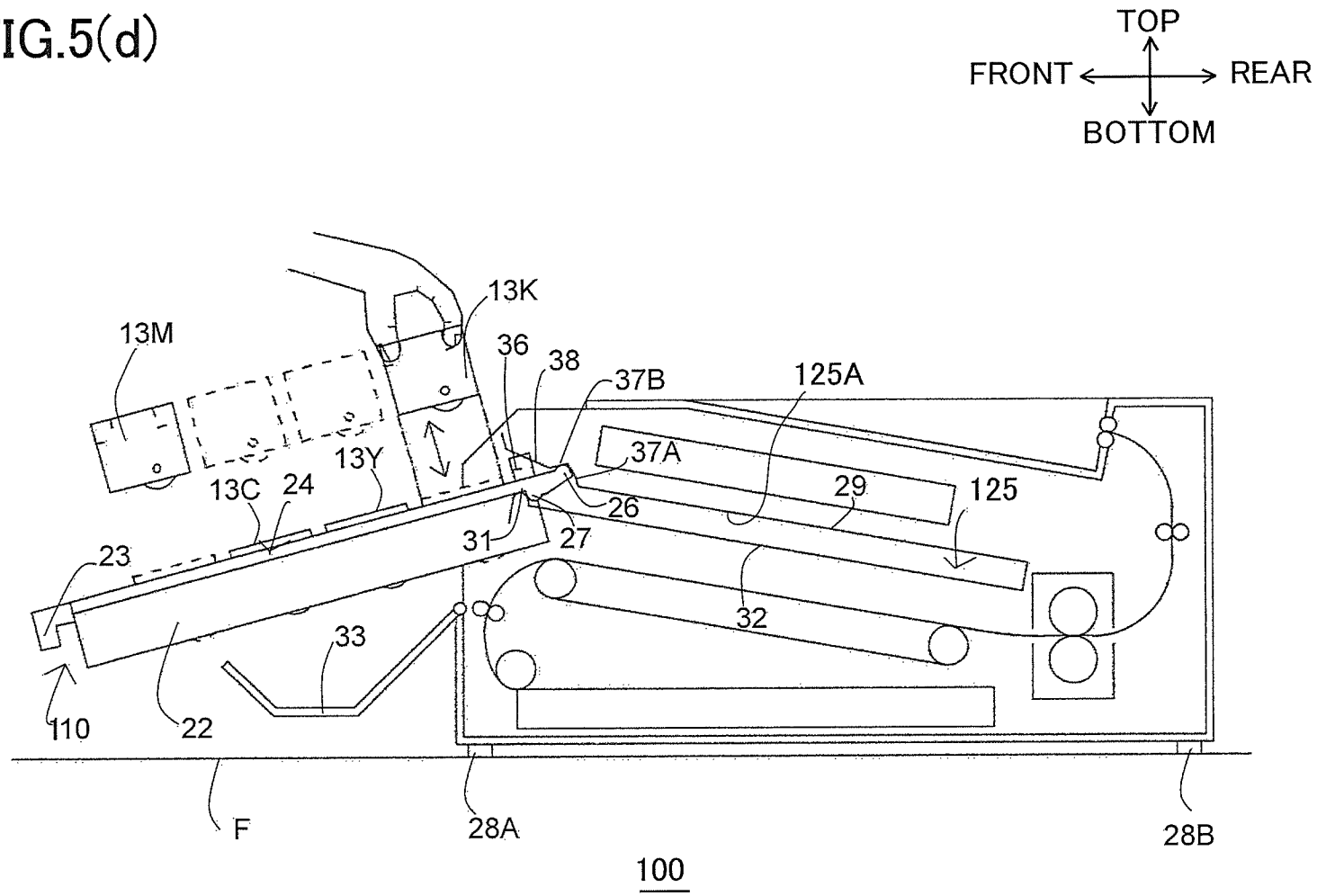
Figure 5E:
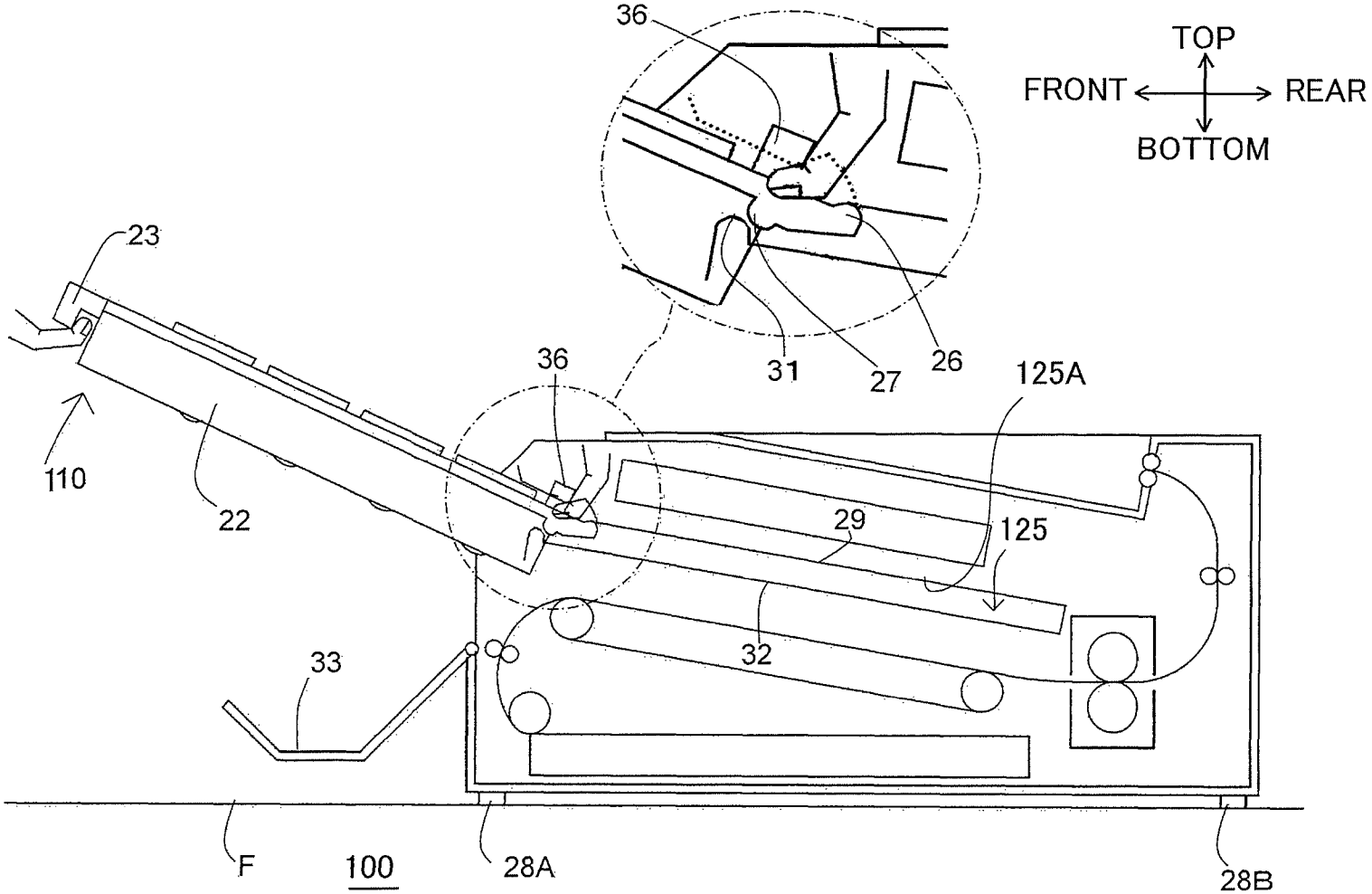
Figure 6A:
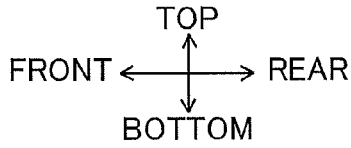
FIG. 6(*a*) is a schematic cross-sectional view showing a printer according to a third embodiment of the present invention when the cartridge support member is disposed in an internal position.
Figure 6A:
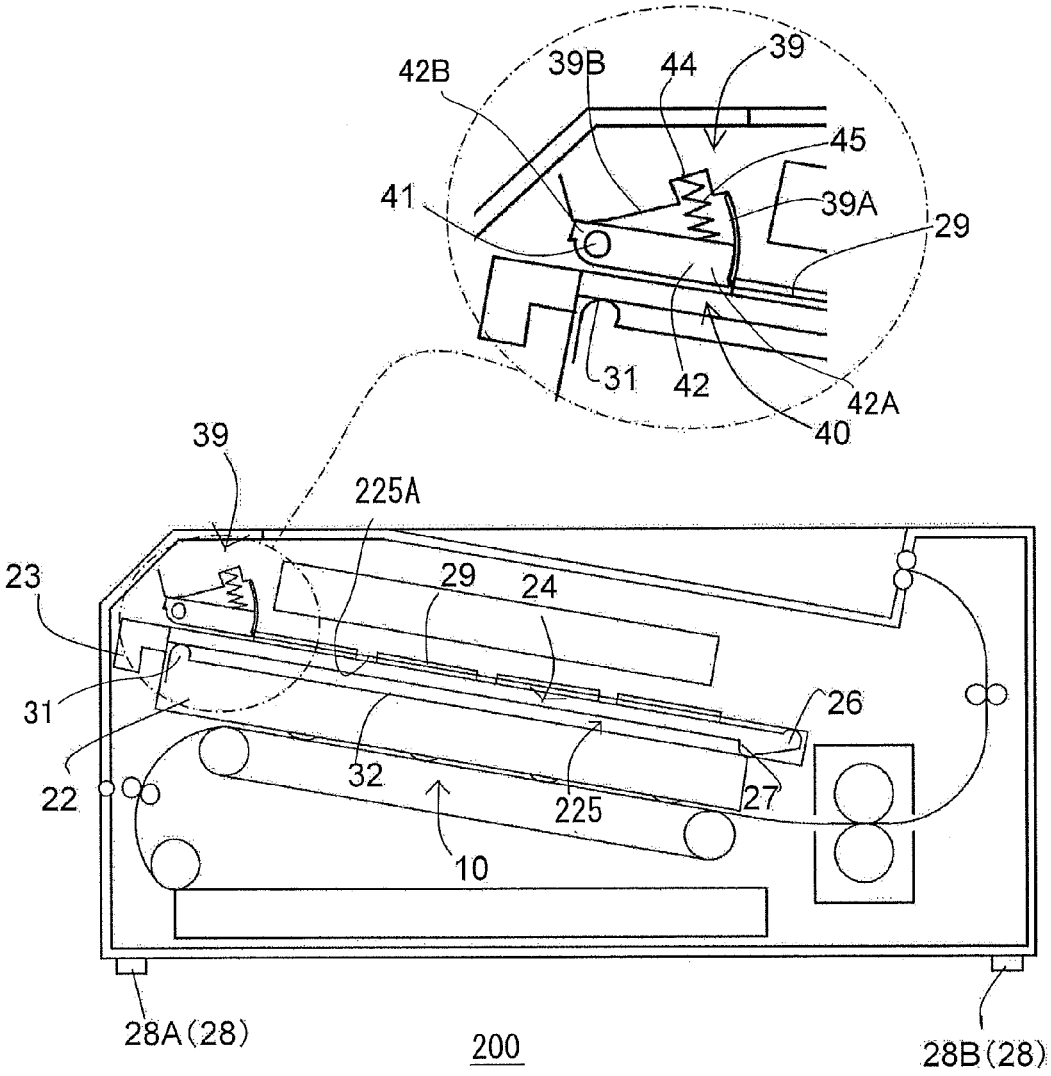
Figure 6B:
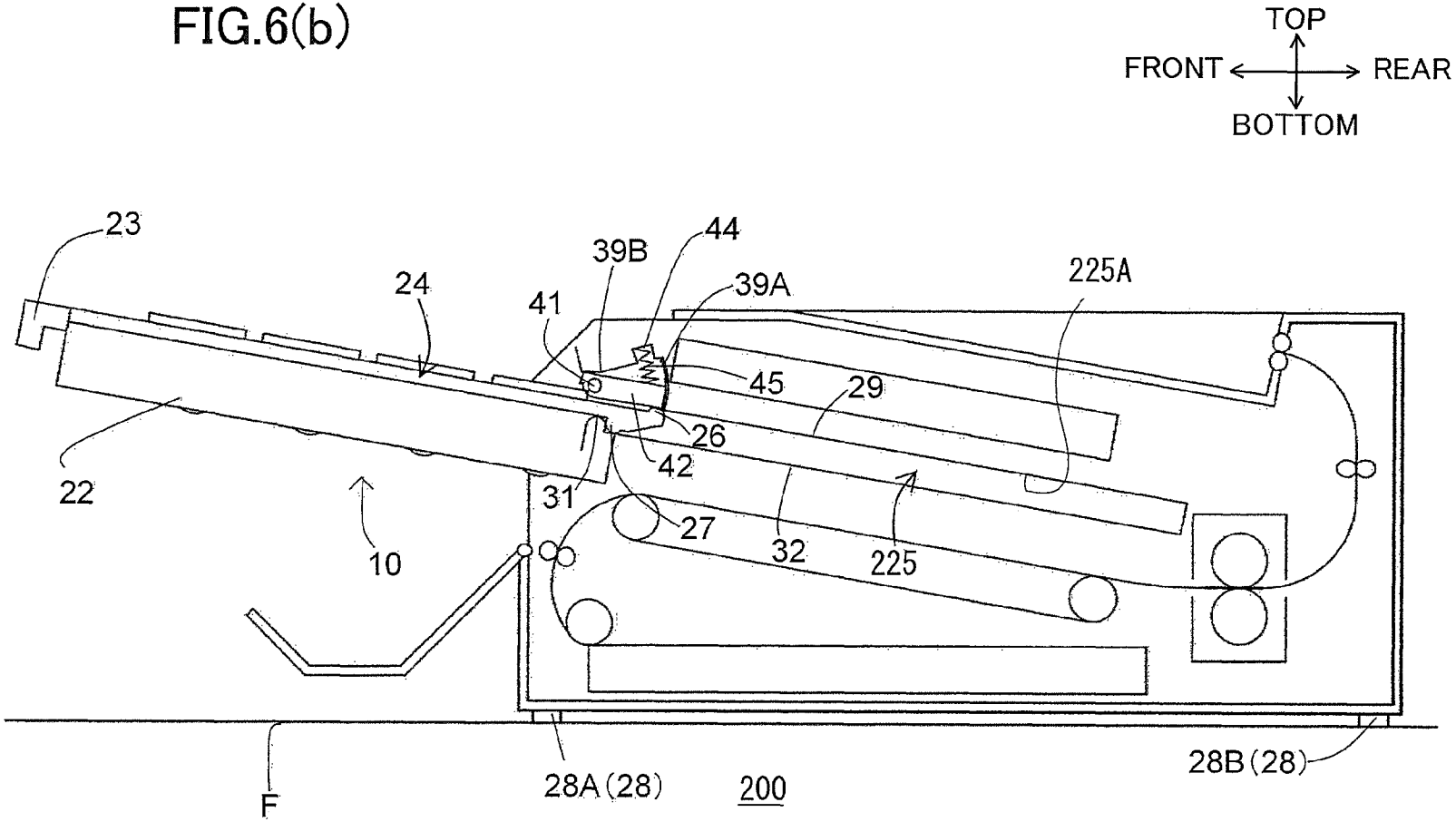
Figure 6C:
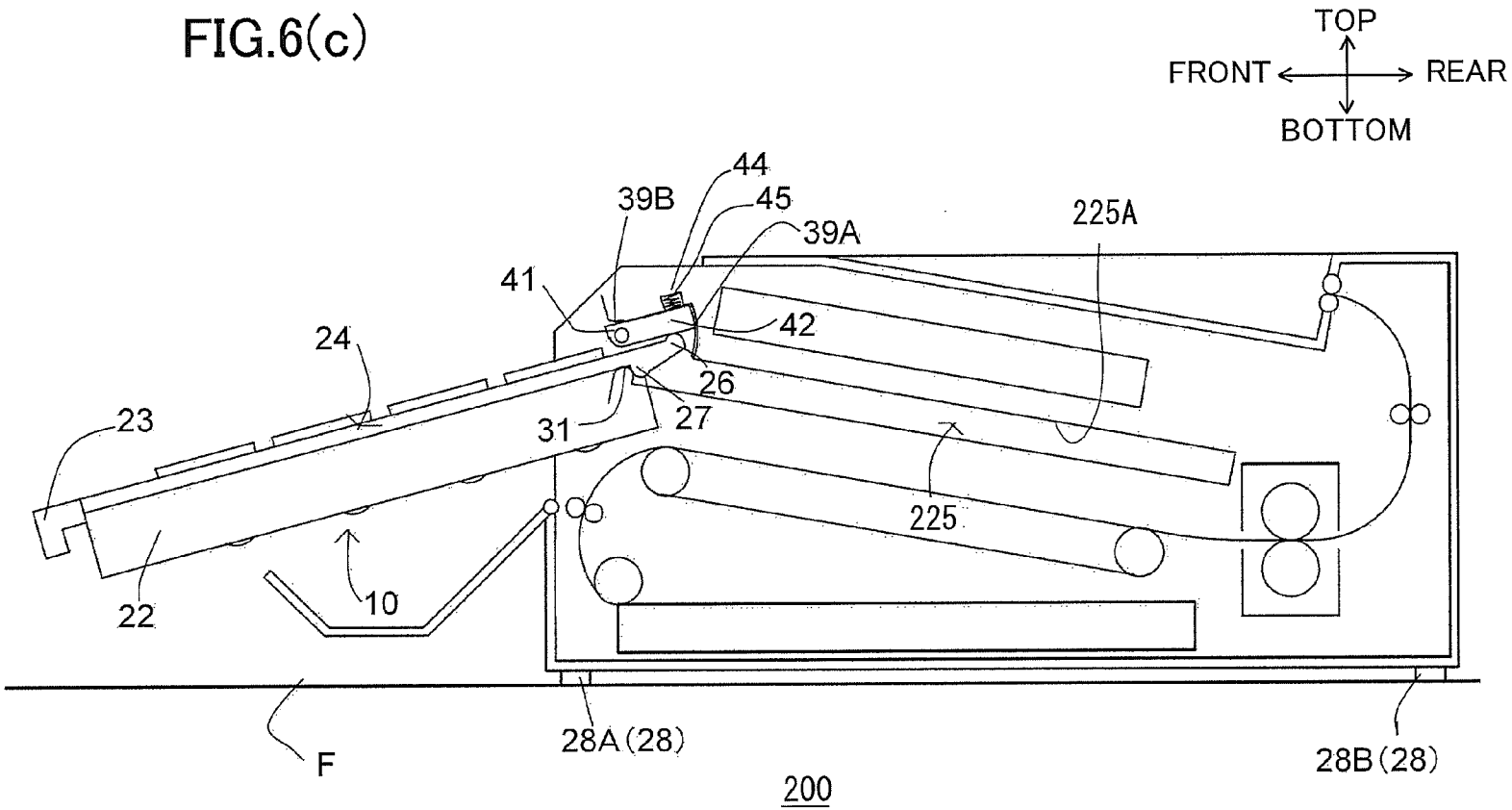
Figure 7A:
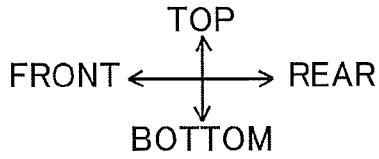
FIG. 7(*a*) is a schematic cross-sectional view showing a printer according to a fourth embodiment of the present invention when the cartridge support member is disposed in an internal position.
Figure 7A:
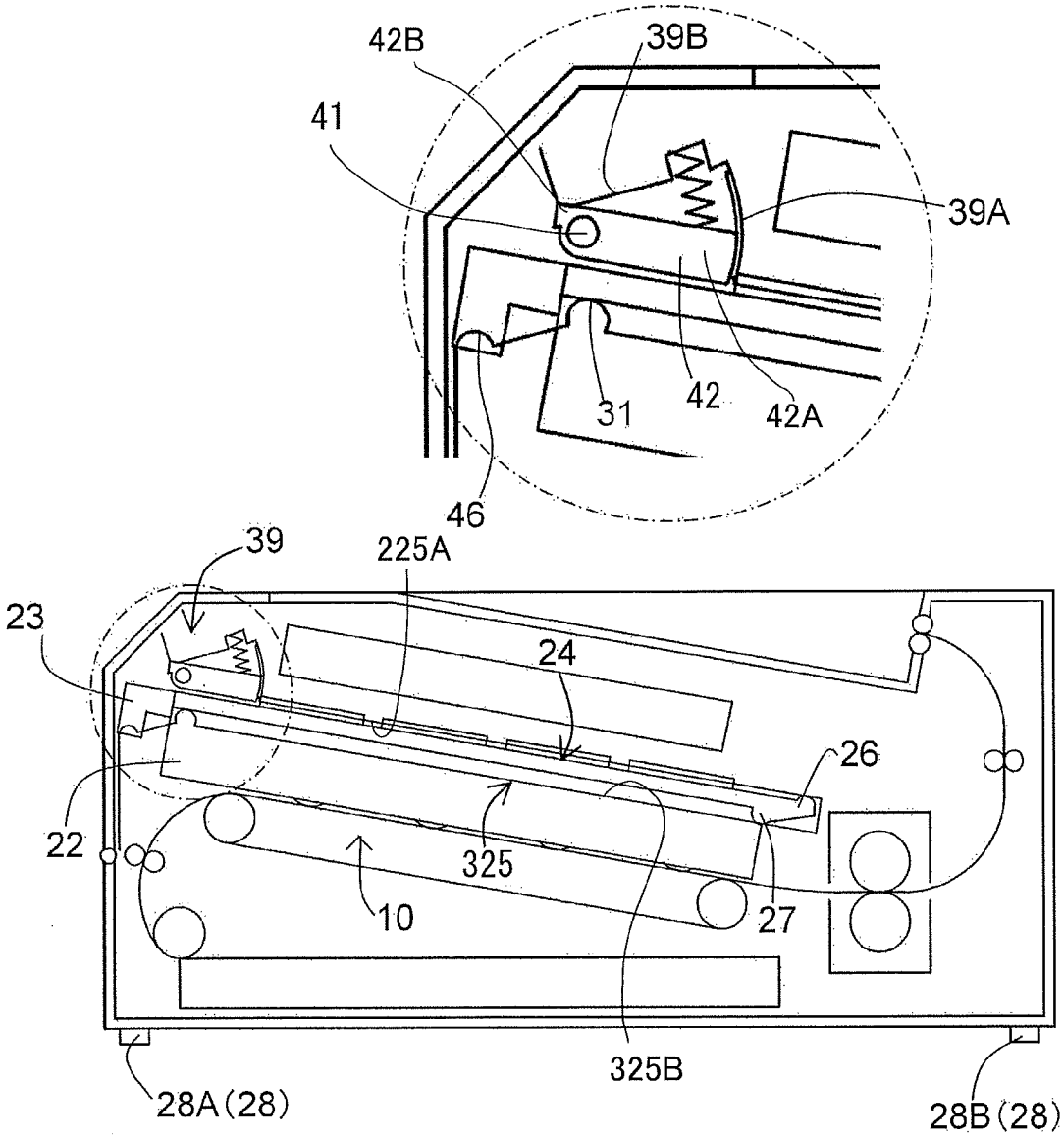
Figure 7B:
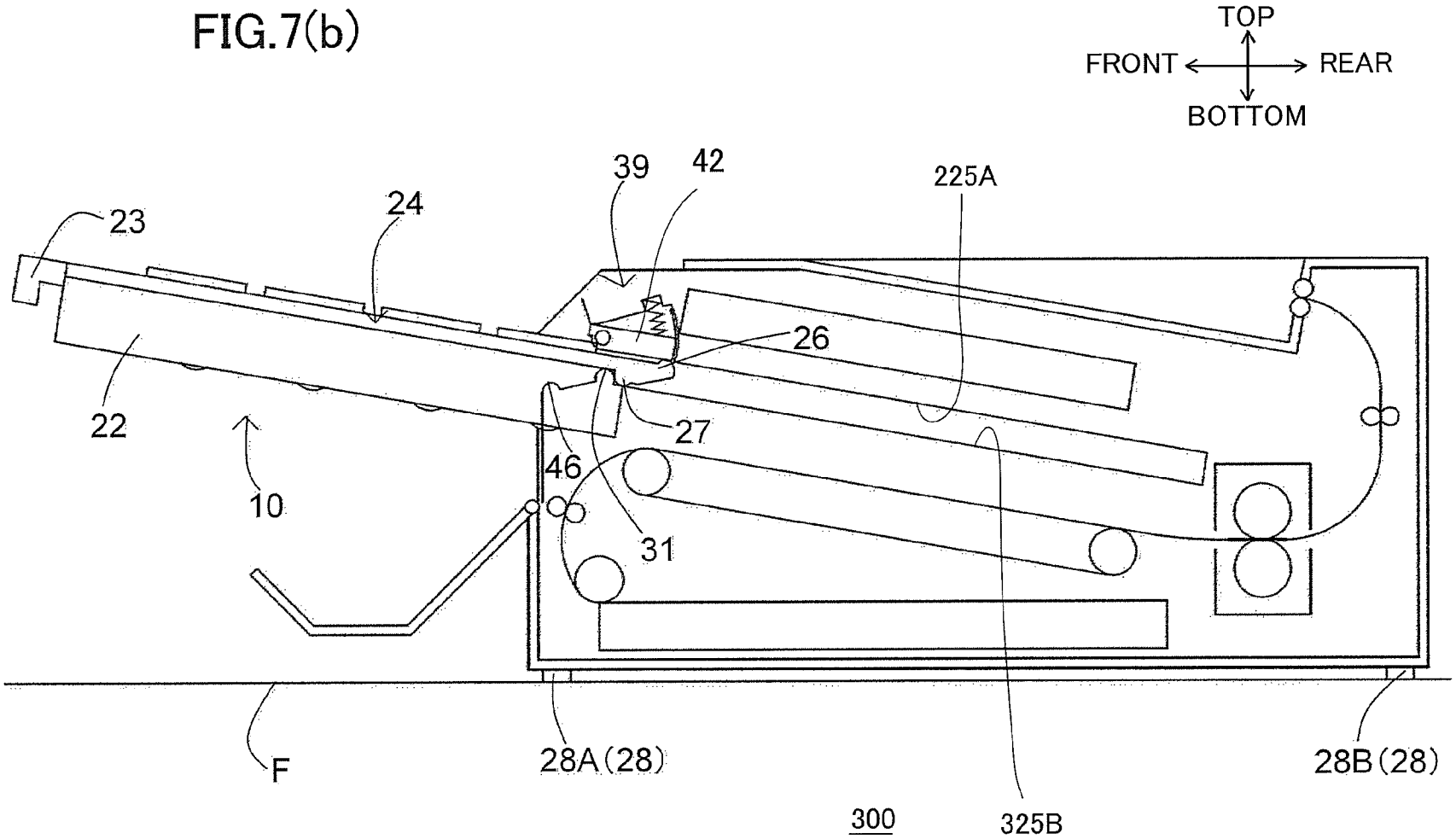
Figure 7C:
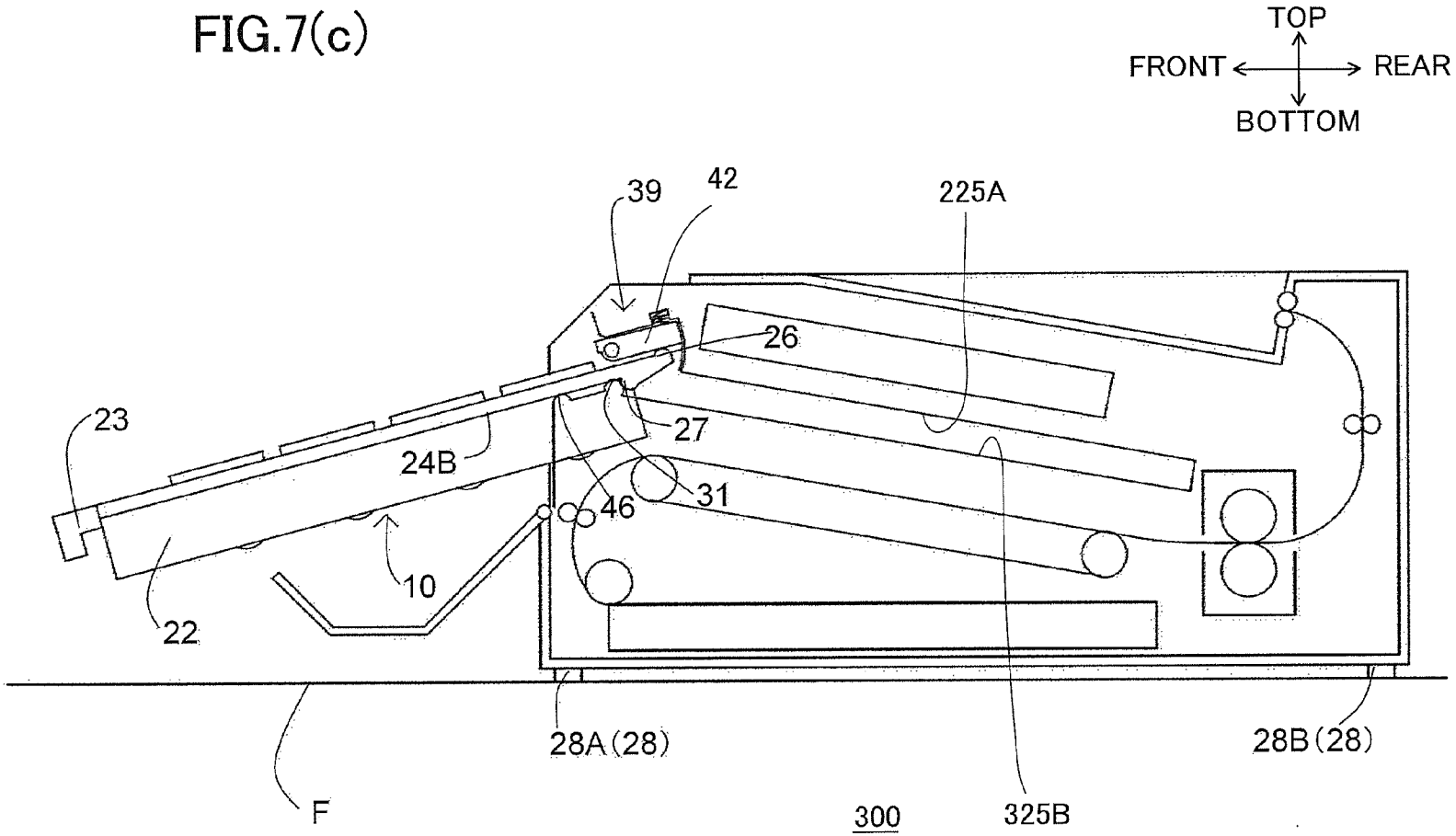

The cartridge housing case 22 is box-shaped and elongated in the front-to-rear direction. When viewed from above, the cartridge housing case 22 has a substantially rectangular outline. The cartridge housing case 22 houses the four process cartridges 13. The top and bottom of the cartridge housing case 22 are open, and the process cartridges 13 are mounted into and removed from the cartridge housing case 22 through its open top. Also, the photosensitive drums 14 are popped out through the open bottom. As shown in FIG. 3, the cartridge housing 22 has an upstream end portion 22A and a downstream end portion 22B disposed downstream of the upstream end portion 22A in a pulled-out direction.

The front grip 23 is disposed on outer side of a front wall constituting the cartridge housing case 22, and specifically in the left-to-right center of the front wall near the top edge, and extends forward. The user grips the front grip 23 to move the cartridge support member 10 relative to the main casing 2.

The sliding parts 24 protrude outward from the left and right edges of the cartridge housing case 22 in the left and right directions respectively. The sliding parts 24 are supported in guide parts 25 described later.

Next, the sliding parts 24 of the cartridge support member 10 will be described in detail with reference to FIG. 3. As shown in FIG. 3, each sliding part 24 has a top surface 24A and a bottom surface 24B that are substantially parallel along the front-to-rear direction and separated by a prescribed distance, an extended part 24D extending linearly, and a protruding part 24C protruding rearward from the extended part 24D.

The front end of the extended part 24D extends to the front edge of the cartridge housing case 22. The rear end of the extended part 24D extends to a point just in front of the rear edge of the cartridge housing case 22.

The protruding part 24C protrudes from the rear end of the extended part 24D farther rearward than a rear wall of the cartridge housing case 22. In other words, the protruding part 24C protrudes from the main casing 2 in a direction away from the downstream end portion 22B. The protruding part 24C includes a first contact portion 26, and a second contact portion 27.

The first contact portion 26 is disposed farther rearward than the rear wall 22A of the cartridge housing case 22 and protrudes diagonally upward and rearward. The first contact portion 26 has a semicircular shape that protrudes above the top surface 24A of the sliding part 24.

The second contact portion 27 has a semicircular shape and is provided near the rear wall of the upstream end portion 22A. The second contact portion 27 protrudes farther downward than the bottom surface 24B of the sliding part 24. The second contact portion 27 is positioned forward of the first contact portion 26.

The gap between the top surface 24A and bottom surface 24B of the sliding part 24 becomes gradually smaller from the second contact portion 27 to the first contact portion 26. More specifically, the bottom surface 24B of the sliding part 24 has a sloped surface 35 that slopes relative to the top surface 24A from the rear end of the protruding part 24C toward the second contact portion 27. The second contact portion 27 is formed to protrude farther downward than the sloped surface 35.

Here, the main casing 2 will be described in greater detail with reference to FIG. 3. The main casing 2 has a box shape and is generally rectangular in a side view. The main casing 2 includes the guide parts 25, feet 28, and a front cover 33.

The guide parts 25 are provided in each side plate of the main casing 2 at positions corresponding to the left and right sliding parts 24 of the cartridge support member 10. The guide parts 25 extend in the front-to-rear direction and have a length approximately equal to the front-to-rear length of the cartridge support member 10. The guide parts 25 are approximately parallel to the paper-conveying belt 12. In other words, the guide parts 25 slope downward from front to rear. Each guide part 25 is configured to support the cartridge support member 10 and to guide movement of the cartridge support member 10 between the internal position and the external position. Each guide part 25 has an upper guide surface 25A, a lower guide surface 25B, a rear surface 25C, and a front surface 25D. The upper lower guide surface 25A extends in a direction parallel to the pulled-out direction.

The upper guide surface 25A is formed of polystyrene. The upper guide surface 25A slopes downward from front to rear and contacts the first contact portion 26 except when the cartridge support member 10 is disposed in the external position (FIG. 4(*b*)). The upper guide surface 25A has an upper linear part 29 and a receiving part 30.

The upper linear part 29 is a portion of the upper guide surface 25A that extends in a straight line along a downward slope from front to rear. In other words, the upper linear part 29 extends in a direction parallel to the pulled-out direction. The upper linear part 29 slopes at approximately 10 degrees to an installation surface F (the surface on which the printer 1 rests). When the cartridge support member 10 is accommodated in the main casing 2, the upper linear part 29 extends from a point near the front edge of the frontmost magenta process cartridge 13M to a point near the front edge of the fixing unit 5. The first contact portion 26 is in contact with the upper linear part 29 when the cartridge support member 10 is moved between the internal position (FIG. 4 (*a*)) and external position (FIG. 4(*b*)).

The receiving part 30 accounts for the front portion of the upper guide surface 25A and is arranged higher than the upper linear part 29. The receiving part 30 is disposed downstream of the upper linear part 29 in the pulled-out direction. The receiving part 30 receives and supports the cartridge support member 10 when the cartridge support member 10 rotates from the external position (FIG. 4(*b*) to the cartridge mounting position (FIGS. 4(*c*) and 4(*d*)).

As shown in the enlarged view of FIG. 3, the receiving part 30 has a pivot-restricting part 30B that is contacted by the first contact portion 26 of the cartridge support member 10 and restricts further rotation of the cartridge support member 10, and a guiding part 30A for guiding the movement of the first contact portion 26 of the cartridge support member 10 toward the pivot-restricting part 30B as the cartridge support member 10 is moved toward the cartridge mounting position.

The guiding part 30A extends from the front edge of the upper linear part 29 along a gently curved path extending upward and forward at an angle of incidence relative to the installation surface F greater than that of the upper linear part 29. The guiding part 30A is disposed upstream of the pivot-restricting part 30B in the pulled-out direction and connected with the pivot-restricting part 30B. The guiding part 30A extends toward the pivot-restricting part 30B and diagonally upward with respect to the lower guide surface 25B. The guiding part 30A is contacted by the first contact portion 26 when the cartridge support member 10 pivots from the external position to the cartridge mounting position and serves to guide the movement of the first contact portion 26 toward the pivot-restricting part 30B.

The pivot-restricting part 30B extends in a straight line from the front end of the guiding part 30A along a direction sloped diagonally downward and forward. The pivot-restricting part 30B extends diagonally upward with respect to the lower guide surface 25B from the downstream end of the upper guide surface 25A. The front edge of the pivot-restricting part 30B falls on an imaginary plane N passing through the upper linear part 29. As the cartridge support member 10 pivots from the external position to the cartridge mounting position, the pivot-restricting part 30B receives and is contacted by the first contact portion 26 and restricts further pivoting of the cartridge support member 10. Since the pivoting of the cartridge support member 10 can be restricted by the pivot-restricting part 30B, the tilted angle of the cartridge support member 10 in the cartridge mounting position changes according to the position at which the pivot-restricting part 30B is provided.

The lower guide surface 25B is formed of polystyrene. The lower guide surface 25B is disposed below the upper guide surface 25A and extends parallel to the upper guide surface 25A. The lower guide surface 25B slopes downward from front to rear and is in constant contact with the second contact portion 27. The lower guide surface 25B has a lower linear part 32 for guiding the cartridge support member 10 between the internal position and external position, and the fulcrum part 31 for supporting the cartridge support member 10 as the cartridge support member 10 pivotably moves between the external position and the cartridge mounting position.

The lower linear part 32 extends in a straight line along a downward slope from front to rear. The lower linear part 32 slopes at approximately 10 degrees to the installation surface F and extends to a point near the front edge of the fixing unit 5. The lower linear part 32 is in contact with the second contact portion 27 when the cartridge support member 10 is moved between the internal position and external position. The upper linear part 29 and lower linear part 32 are configured to be substantially parallel to each other and separated by a prescribed gap L1.

The fulcrum part 31 is provided on the front of the lower guide surface 25B. The fulcrum part 31 protrudes upward higher than the lower linear part 32. The rear edge of the fulcrum part 31 is connected to the front edge of the lower linear part 32. The fulcrum part 31 is a semicircular protrusion that extends above the lower linear part 32. The cartridge support member 10 pivots about the fulcrum parts 31 from the external position to the cartridge mounting position, while the second contact portions 27 are in contact with the fulcrum parts 31. When the cartridge support member 10 is in the cartridge mounting position, the fulcrum parts 31 remain in contact with the second contact portions 27 and support the cartridge support member 10. Since the second contact portions 27 contact the fulcrum parts 31, the second contact portions 27 cannot move downward when the cartridge support member 10 is in the cartridge mounting position.

The rear surface 25C is a surface defining the guide part 25 that linearly connects the rear edges of the upper linear part 29 and lower linear part 32. The front surface 25D extends linearly upward and forward from the front edge of the pivot-restricting part 30B.

The feet 28 extend downward from the bottom surface of the main casing 2 for contacting the installation surface F. The feet 28 include a pair of left and right front feet 28A positioned farther forward than the fulcrum part 31, and a pair of left and right rear feet 28B positioned farther rearward than the fixing unit 5.

The front cover 33 is provided on the front side of the main casing 2 and is capable of opening and closing thereon. The front cover 33 is capable of pivoting relative to the main casing 2 about its lower edge. Pivoting the top edge of the front cover 33 forward and downward exposes an access opening 34 formed in the main casing 2. The cartridge support member 10 passes through the access opening 34 when moving between the internal and external positions. The front cover 33 covers the access opening 34 when closed as shown in FIG. 3.

As shown in FIG. 3, a gap L2 between the upper guide surface 25A and lower guide surface 25B at the front end of the guide part 25 is smaller than the gap L1 between the upper guide surface 25A and lower guide surface 25B along the upper linear part 29 and lower linear part 32. When the cartridge support member 10 is accommodated in the main casing 2, the first contact portions 26 contact the upper linear parts 29 and the second contact portions 27 contact the lower linear parts 32. Accordingly, the gap between the upper guide surfaces 25A and lower guide surfaces 25B of the protruding parts 24C is approximately equivalent to the gap L1. Since there is insufficient space at the front ends of the guide parts 25 for the protruding parts 24C to come out of the main casing 2, the cartridge support member 10 cannot be removed from the main casing 2 in the first embodiment.

3. Pulling the Cartridge Support Member out from the Main Casing

Next, the process for pulling the cartridge support member 10 out from the main casing 2 and removing the process cartridges 13 will be described with reference to FIGS. 4(*a*) through 4(*d*). To pull the cartridge support member 10 out of the main casing 2, first the operator opens the front cover 33, as shown in FIG. 4(*a*). Opening the front cover 33 exposes the access opening 34 formed in the main casing 2 and provides the operator with access to the main casing 2. With the printer 1 in the state shown in FIG. 4(*a*), the operator grips the front grip 23 of the cartridge support member 10 and pulls the cartridge support member 10 out of the main casing 2 until the second contact portions 27 contact the fulcrum parts 31 and halt sliding movement of the cartridge support member 10, i.e., the external position shown in FIG. 4(*b*). When the cartridge support member 10 moves from the internal position to the external position, the cartridge support member 10 slides with the second contact portions 27 in contact with the lower linear parts 32 and the first contact portions 26 in contact with the upper linear parts 29 as the cartridge support member 10 emerges from the main casing 2.

After the cartridge support member 10 has been pulled out of the main casing 2 to the external position in FIG. 4(*b*), the operator can pull down on the front grip 23 of the cartridge support member 10 so that the front end of the cartridge support member 10 pivots downward toward the installation surface F to the state shown in FIG. 4(*c*). At this point, the cartridge support member 10 is held in the tilted state shown in FIG. 4(*c*). That is, by pulling down on the front grip 23 of the cartridge support member 10, the cartridge support member 10 pivots downward about the fulcrum parts 31 while the second contact portions 27 separate from the lower linear parts 32. At the same time, the first contact portions 26 moves upward in contact with the guiding parts 30A until the first contact portions 26 contact the pivot-restricting parts 30B of the support parts 30 and come to a stop in the position shown in FIG. 4(*c*). Consequently, rotation of the cartridge support member 10 comes to a halt, and the cartridge support member 10 is supported in the tilted state of FIG. 4(*c*). At this time, the second contact portions 27 are positioned farther rearward than the front feet 28A. Further, the cartridge support member 10 is supported at a suitable angle of inclination to prevent contact with the open front cover 33, as well as the installation surface F.

With the cartridge support member 10 sloped as shown in FIG. 4(*c*), the operator facing the front of the printer 1 can remove process cartridges 13 from the cartridge support member 10 by pulling the process cartridges 13 out of the cartridge support member 10 in a direction toward the operator, as illustrated in FIG. 4(*d*). Accordingly, it is much easier for the operator to replace process cartridges 13 in this state than when the cartridge support member 10 is not inclined toward the user, as in the state shown in FIG. 4(*b*).

4. Operations and Effects of the First Embodiment (1) As described above, the printer 1 includes the main casing 2, the cartridge support member 10 supporting a plurality of process cartridges 13, and the guide parts 25 provided inside the main casing 2. The cartridge support member 10 is capable of sliding between the internal position inside the main casing 2 shown in FIG. 4(*a*), and the external position outside the main casing 2 shown in FIG. 4(*b*). The cartridge support member 10 is further able to rotate between the external position and a cartridge mounting position for mounting and removing the process cartridges 13. In the cartridge mounting position shown in FIG. 4(*c*), the cartridge support member 10 is rotated about its upstream side with respect to the direction that the cartridge support member 10 is pulled out of the main casing 2, so that the cartridge support member 10 slopes downward toward its downstream side.

The guide parts 25 provided in the main casing 2 guide the cartridge support member 10 while the cartridge support member 10 moves between the internal position and external position and between the external position and the cartridge mounting position, and support the cartridge support member 10 when the cartridge support member 10 is in the cartridge mounting position. Each guide part 25 has an upper guide surface 25A extending linearly in the direction that the cartridge support member 10 is pulled from the internal position to the external position, and the lower guide surface 25B extending substantially parallel to the corresponding upper guide surface 25A and opposing the upper guide surface 25A from below.

Since the front end of the cartridge support member 10 in the cartridge mounting position is lower than the front end of the cartridge support member 10 in the external position, the direction for mounting and removing the process cartridges 13 from the cartridge support member 10 is angled toward the user, thereby facilitating the user in cartridge replacement.

The cartridge support member 10 also has the first contact portions 26 and second contact portions 27 on the upstream end portion 22A. When the cartridge support member 10 is disposed in the cartridge mounting position, the first contact portions 26 contact the upper guide surfaces 25A, preventing the rear end of the cartridge support member 10 from moving farther upward. At the same time, the second contact portions 27 contact the lower guide surfaces 25B, preventing the front side of the cartridge support member 10 from moving farther downward.

As a result, the guide parts 25 used for facilitating movement of the cartridge support member 10 between the external position and internal position can also easily support the cartridge support member 10 in the cartridge mounting position. The guide parts 25 further include corresponding fulcrum parts 31 that serve as the rotating center of the cartridge support member 10 when contacted by the second contact portions 27, as the cartridge support member 10 moves from the external position to the cartridge mounting position, and the support parts 30 that supports the cartridge support member 10 when contacted by the first contact portions 26. The fulcrum parts 31 protrude upward from the front ends of the corresponding lower guide surfaces 25B. The support parts 30 are recessed upward at the front ends of the upper guide surfaces 25A.

Through this construction, the cartridge support member 10 can be supported with stability when in the cartridge mounting position. Further, the cartridge support member 10 can rotate between the external position and the cartridge mounting position through a structure that includes only the guide parts 25.

The support parts 30 further include the pivot-restricting parts 30B that restrict further downward rotation by the cartridge support member 10 from the cartridge mounting position when contacted by the first contact portions 26 as the cartridge support member 10 reaches the cartridge mounting position, and the guiding parts 30A for guiding the first contact portions 26 as the cartridge support member 10 rotates from the external position to the cartridge mounting position. The pivot-restricting parts 30B extend in a direction diagonally upward and rearward from the front ends of the upper guide surfaces 25A. The guiding parts 30A extend diagonally downward and rearward from the rear ends of the pivot-restricting parts 30B.

This construction can smoothly guide the cartridge support member 10 from its external position to the cartridge mounting position and can reliably support the cartridge support member 10 in the cartridge mounting position.

The cartridge support member 10 further includes the cartridge housing case 22 that accommodates a plurality of cartridges, and the protruding parts 24C that protrude rearward from the cartridge support member 10. The protruding parts 24C further include the first contact portions 26 and second contact portions 27. The first contact portions 26 protrude upward, while the second contact portions 27 protrude downward.

With this construction, the first contact portions 26 and second contact portions 27 are provided rearward of the cartridge housing case 22. Accordingly, the cartridge support member 10 can be pulled farther forward from the main casing 2, facilitating the user in replacing process cartridges 13.

The main casing 2 also has the pair of front feet 28A provided on the bottom of the main casing 2 near the front side, and the pair of rear feet 28B provided on the bottom of the main casing 2 near the rear side. The fulcrum parts 31 are disposed between the front feet 28A and rear feet 28B with respect to the front-to-rear direction and closer to the front feet 28A than the rear feet 28B, as viewed from the above the casing.

This construction makes the main casing 2 more stable by preventing the main casing 2 from tipping over when the cartridge support member 10 is in the cartridge mounting position.

Next, a printer 100 according to a second embodiment will be described with referring to FIGS. 5(*a*) through 5(*e*). As shown in FIG. 5(*a*), a cartridge support member 110 has a rear grip 36 in addition to the front grip 23. The rear grip 36 is provided on the rear end of the cartridge housing case 22 and extends upward above the rear end of the cartridge housing case 22 from the left-to-right center portion thereof. An operator grips the rear grip 36 together with the front grip 23 in order to remove the cartridge support member 110 from the main casing 2.

Guide parts 125 will be described while referring to FIG. 5(*a*). As shown in FIG. 5(*a*), each upper guide surface 125A in the second embodiment is same as the upper guide surface 25A except that a receiving part 37 is provided in place of the receiving part 30 described in the first embodiment. The receiving part 37 has a guiding part 37A similar to the guiding part 30A of the first embodiment, and a pivot-restricting part 37B extending linearly along a downward and forward slope from the front end of the guiding part 37A. The front end of the pivot-restricting part 37B is positioned higher than the imaginary plane N, which extends straight forward from the front edge of the upper linear part 29. The front end (downstream end) of the pivot-restricting part 37A is disposed opposite to the lower guide surface 25B with respect to the imaginary plane N including the upper linear part 29. In other words, the pivot-restricting part 37B portion of the upper guide surface 125A extending linearly along a diagonal direction sloping downward and forward is shorter than the pivot-restricting part 30B described in the first embodiment. The upper guide surface 125A also has a front surface 38 that extends linearly along a diagonal direction sloping upward and forward from the front end of the pivot-restricting part 37B.

As shown in FIG. 5(*a*), a gap L22 between the upper guide surface 125A and lower guide surface 25B at the front end of the guide part 25 is greater than a gap L1 between the upper guide surface 125A and lower guide surface 25B of the upper linear part 29 and lower linear part 32. Therefore, the distance L1 between opposing upper guide surface 125A and lower guide surface 25B around the protruding part 24C is less than the gap L22.

Next, the process for pulling the cartridge support member 10 out of the main casing 2 and removing the process cartridges 13 will be described with reference to FIGS. 5(*b*) through 5(*d*).

As described in the first embodiment for pulling the cartridge support member 110 out of the main casing 2, first the operator opens the front cover 33 pivotably disposed on the front of the main casing 2. The operator grips the front grip 23 of the cartridge support member 110 and pulls the cartridge support member 110 out of the main casing 2 until the second contact portions 27 contact the fulcrum parts 31, halting sliding movement of the cartridge support member 10, i.e., at the position shown in FIG. 5(*b*). Next, the operator pulls the front grip 23 of the cartridge support member 110 downward so that the front end of the cartridge support member 110 rotates toward the installation surface F. At this time, the cartridge support member 110 is maintained in the tilted state shown in FIG. 5(*c*). Specifically, by pulling the front grip 23 downward toward the installation surface F, the front of the cartridge support member 110 pivots about the fulcrum parts 31 toward the installation surface F, and the second contact portions 27 separate from the lower linear parts 32. At the same time, the first contact portions 26 move upward in contact with the guiding parts 37A and come to a halt when contacting the pivot-restricting parts 37B, as shown in FIG. 5(*c*). Consequently, the cartridge support member 110 stops rotating and is supported in a tilted state. With the cartridge support member 110 tilted in this way, the operator facing the printer 1 pulls the process cartridges 13 toward the operator, as shown in FIG. 5(*d*). In other words, tilting the cartridge support member 110 in this way makes it easier for the operator to remove the process cartridges 13 than when the cartridge support member 110 is not tilted, as in the state shown in FIG. 5(*b*).

Next, the process of removing the cartridge support member 110 from the main casing 2 will be described. When the cartridge support member 110 has been pulled out of the main casing 2 to the state shown in FIG. 5(*b*), the operator can grip the rear grip 36. As shown in the enlarged view in FIG. 5(*e*), by lifting the cartridge support member 110 by the rear grip 36 until the second contact portion 27 reaches a height where the second contact portions 27 are not restricted from moving diagonally upward and forward by the fulcrum parts 31, i.e., when the second contact portions 27 are at a height that allow them to pass over the fulcrum parts 31, the cartridge support member 110 can be moved forward and, hence, can be removed from the main casing 2.

In the second embodiment described above, the cartridge support member 110 is detachably mounted in the main casing 2. Therefore, this construction enables the operator to perform maintenance such as replacement of the cartridge support member 110.

Further, the front ends of the pivot-restricting parts 37B are positioned above the imaginary plane N that passes through the upper guide surfaces 125A. Accordingly, the cartridge support member 110 can be mounted in or removed from the main casing 2 smoothly without the protruding parts 24C interfering with the pivot-restricting parts 37B.

Next, a printer 200 according to a third embodiment will be described with reference to FIGS. 6(*a*) through 6(*c*). The printer 200 has guide parts 225 instead of the guide parts 25 according to the first embodiment. The guide parts 225 are same as the guide parts 25 except for an upper guide surface 225A having receiving parts 39. As shown in the enlarged view of FIG. 6(*a*), each of the receiving parts 39 includes a guide part 39A, and a pivot-restricting part 39B.

The guide part 39A describes a slight curve extending from the front end of the upper linear part 29 in a direction diagonally upward and forward. The surface of the guide part 39A is formed of a felt-like material, and specifically polystyrene, for a high coefficient of friction.

The pivot-restricting part 39B extends along a downward and forward slope from the front end of the guide part 39A. The pivot-restricting part 39B includes a recess 44, and an urging unit 40. The recess 44 protrudes in a direction diagonally upward and forward. The urging unit 40 functions to urge the first contact portion 26 in a downward direction. The urging unit 40 includes a spring 45, a pivoting member 42, and a shaft 41. The spring 45 is disposed in the recess 44 and is in its natural state in FIG. 6(*a*). The pivoting member 42 can rotate about the shaft 41. The pivoting member 42 has one end portion 42A and another end portion 42B about which the pivoting member 42 being pivotable. The spring 45 is configured to urge the one end portion 42A toward the first contact portion 26.

Next, the operation of the support part 39 when the cartridge support member 10 is pulled out of the main casing 2 will be described with reference to FIGS. 6(*a*) through 6(*c*).

As described in the third embodiment for pulling the cartridge support member 10 out of the main casing 2, the operator grips the front grip 23 of the cartridge support member 10 and pulls the cartridge support member 10 out of the main casing 2 until the second contact portions 27 contact the fulcrum parts 31, halting sliding movement of the cartridge support member 10, i.e., at the position shown in FIG. 6(*b*). At this time, the first contact portions 26 contact the pivoting parts 42 and the spring 45 is maintained in natural state.

Next, the operator pulls the front grip 23 of the cartridge support member 10 downward so that the front end of the cartridge support member 10 rotates toward the installation surface F. At this time, the cartridge support member 10 is maintained in the tilted state shown in FIG. 6(*c*). Specifically, by pulling the front grip 23 downward toward the installation surface F, the front of the cartridge support member 10 pivots about the fulcrum parts 31 toward the installation surface F, and the second contact portions 27 separate from the lower linear parts 32. At the same time, the first contact portions 26 move upward and frontward in contact with the pivoting parts 42. The springs 45 compress as the first contact portions 26 move diagonally upward and forward. The rear ends of the pivoting parts 42 also remain in contact with the guide parts 39A while moving upward and forward as the pivoting parts 42 rotate around their shafts 41. The pivoting parts 42 come to a halt when contacting the pivot-restricting parts 39B of the receiving parts 39, as shown in FIG. 6(*c*). Consequently, the cartridge support member 10 also stops rotating and is supported in a tilted state.

As described above, the urging members 40 are provided beneath the pivot-restricting parts 39B for applying a downward urging force to the first contact portions 26 of the cartridge support member 10 when the cartridge support member 10 rotates from the external position to the cartridge mounting position. The urging members 40 include the pivoting parts 42 for rotating about the shafts 41 provided on one end of the corresponding pivoting parts 42, and the springs 45 for applying a downward urging force to the other end of the pivoting parts 42.

The guide parts 39A are formed of a material having a higher coefficient of friction than the upper linear part 29 (the upper guide surfaces 225A of the guide parts 225 positioned on the rear side of the guide parts 39A). Hence, this construction slows the rotational speed of the cartridge support member 10 as the cartridge support member 10 rotates counterclockwise in FIG. 6(*c*), thereby lessening impact on the process cartridges 13 when the pivoting parts 42 contact the pivot-restricting parts 39B of the receiving parts 39, halting rotation of the cartridge support member 10.

Further, the impact on process cartridges 13 can be lessened more reliably by providing the pivoting parts 42 that pivot about shafts 41 disposed on one end thereof, and the urging members 40 for urging the other end of the pivoting parts 42 opposite the shafts 41.

Next, a printer 300 according to a fourth embodiment will be described with reference to FIGS. 7(*a*) through 7(*c*). As shown in FIG. 7(*a*), guide parts 325 of the printer 300 according to the fourth embodiment are same as the guide parts 225 according to the third embodiment except that a lower guide surface 325B is provided instead of the lower guide surface 25B. The lower guide surface 325B extends along a downward slope from the front end of the fulcrum part 31. A cartridge support member support part 46 is provided on the front end of the lower guide surface 325B. The cartridge support member support part 46 protrudes upward and functions to support the cartridge support member 10 when the cartridge support member 10 is in its tilted state (i.e., in the cartridge mounting position).

FIG. 7(*b*) shows the state of the cartridge support member 10 slid out of the main casing 2 to the point that the second contact portions 27 of the cartridge support member 10 contact the fulcrum parts 31, halting movement of the cartridge support member 10. At this point, the cartridge support member 10 is not contacting the cartridge support member support parts 46. From this state, the operator pulls down on the front grip 23 of the cartridge support member 10, pivoting the front end of the cartridge support member 10 downward toward the installation surface F until the bottom surfaces 24B of the sliding parts 24 contact the cartridge support member support parts 46. This contact prevents the cartridge support member 10 from rotating any further in the counterclockwise direction of FIG. 7(*c*) and supports the cartridge support member 10 in the tilted state shown in FIG. 7(*c*). Thus, the cartridge support member 10 is supported in its tilted state by the cartridge support member support parts 46 in addition to the receiving parts 39 and fulcrum parts 31.

Since pivoting of the cartridge support member 10 is halted when the sliding parts 24 contact the cartridge support member support parts 46, the inclination angle of the cartridge support member 10 when the cartridge support member 10 is supported in its tilted state can be adjusted by varying the vertical position of the cartridge support member support parts 46.

As described above, the cartridge support member support parts 46 are provided on the front side of the fulcrum parts 31 for supporting the cartridge support member 10 in the cartridge mounting position. Since the addition of the cartridge support member support parts 46 increases the number of parts supporting the cartridge support member 10 in the cartridge mounting position, this construction can support the cartridge support member 10 with greater stability.

Figure 8A:
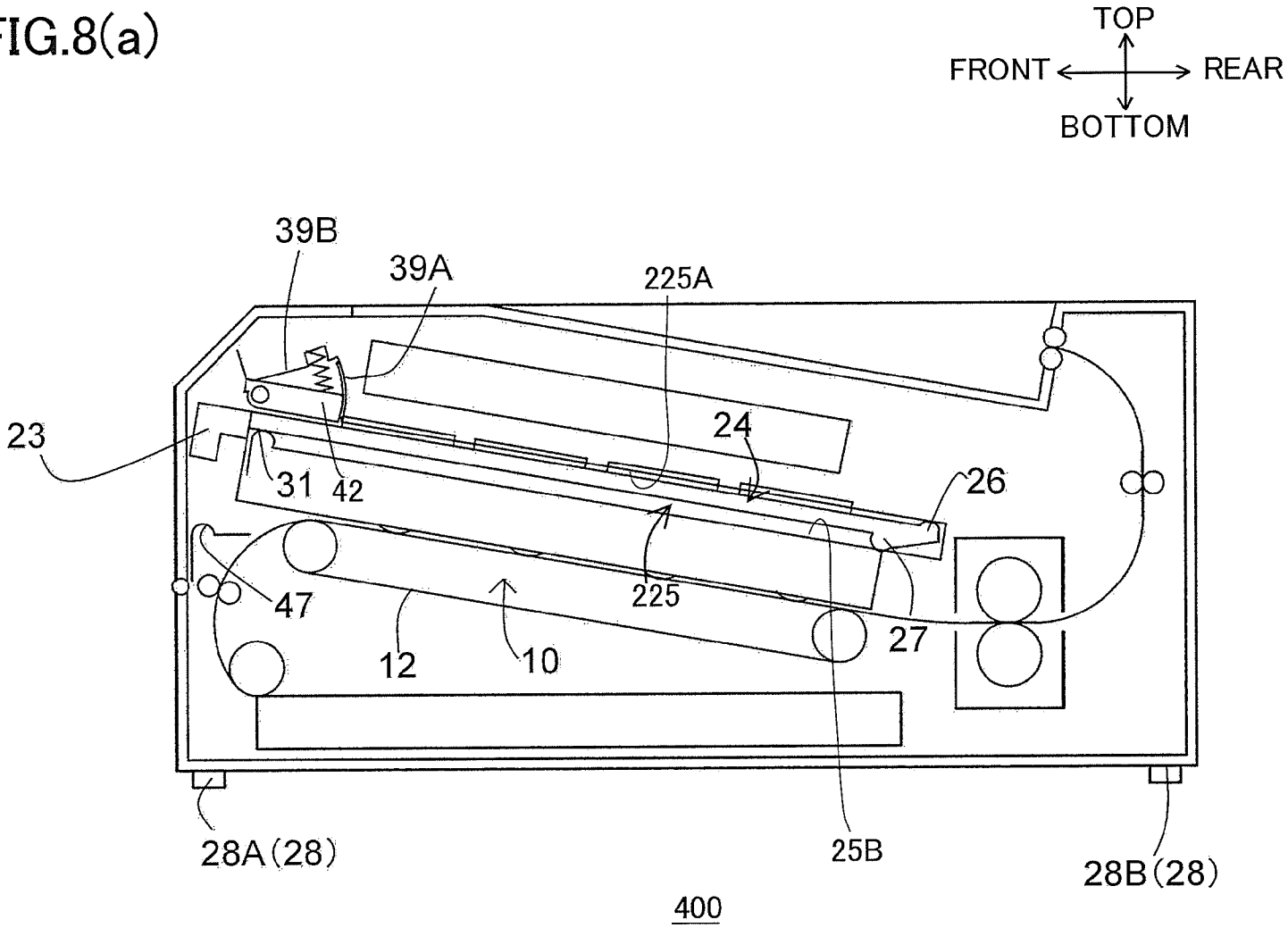
FIG. 8(*a*) is a schematic cross-sectional view showing a printer according to a fifth embodiment of the present invention when the cartridge support member is disposed in an internal position.
Figure 8B:
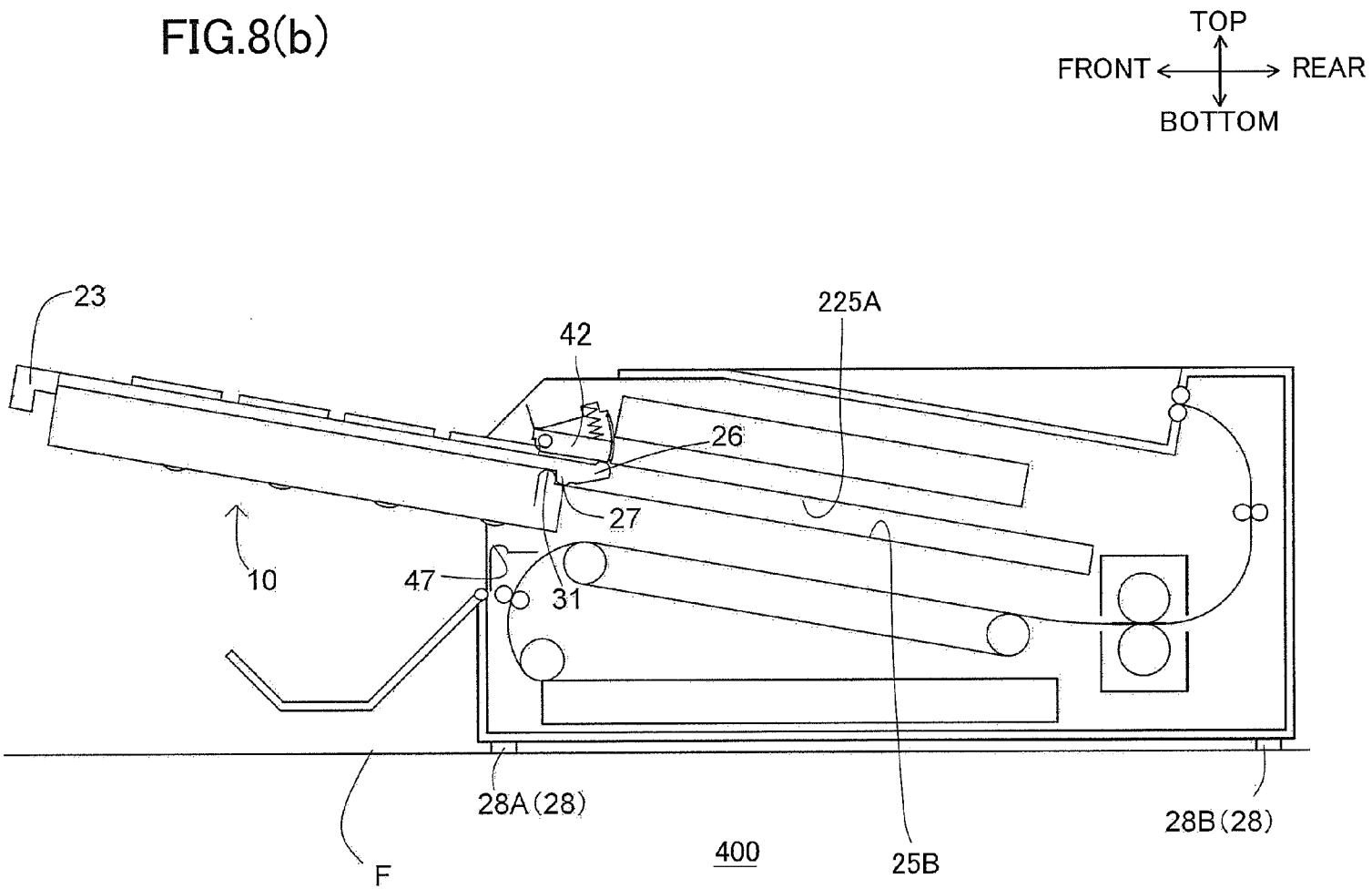
Figure 8C:
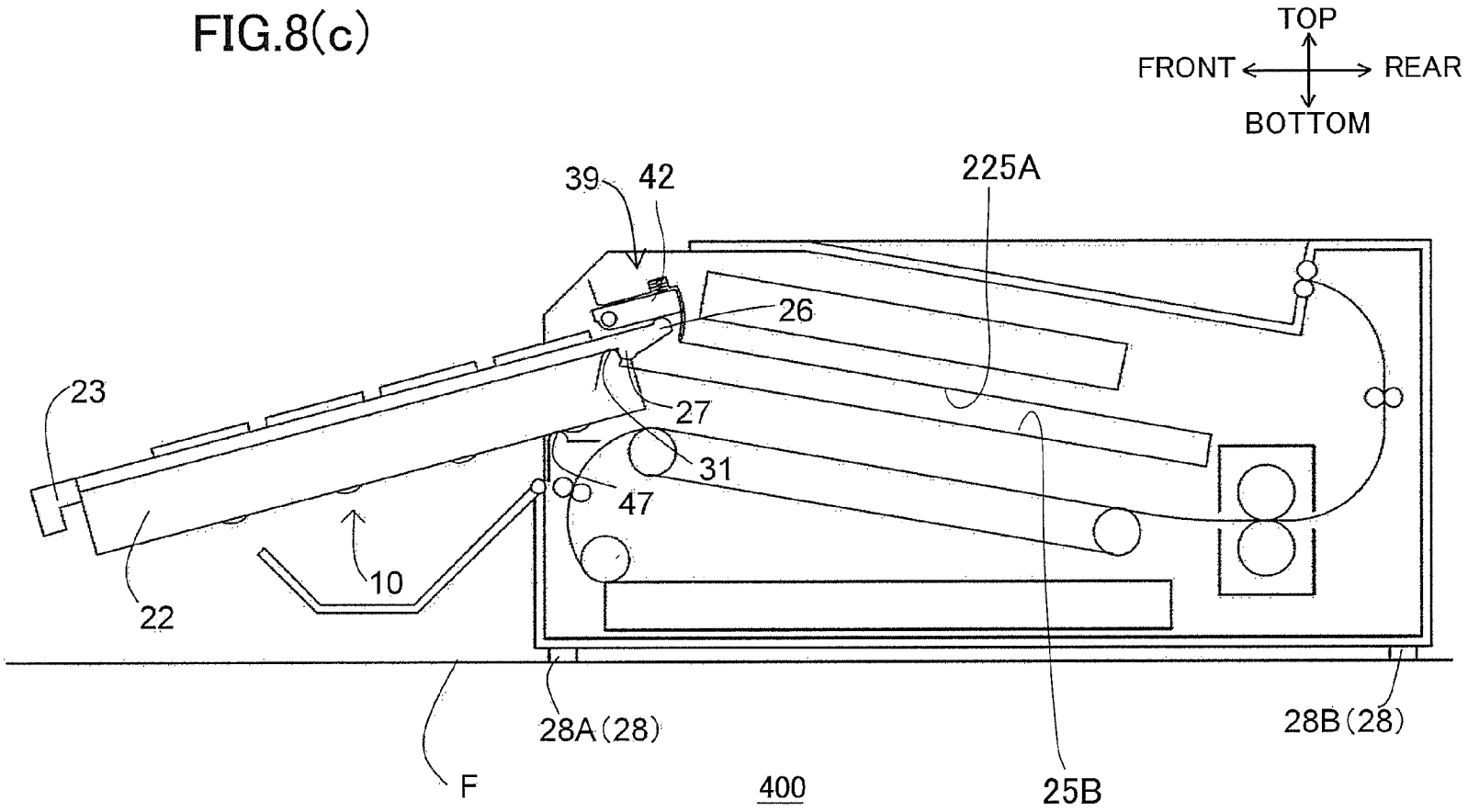
Figure 9A:
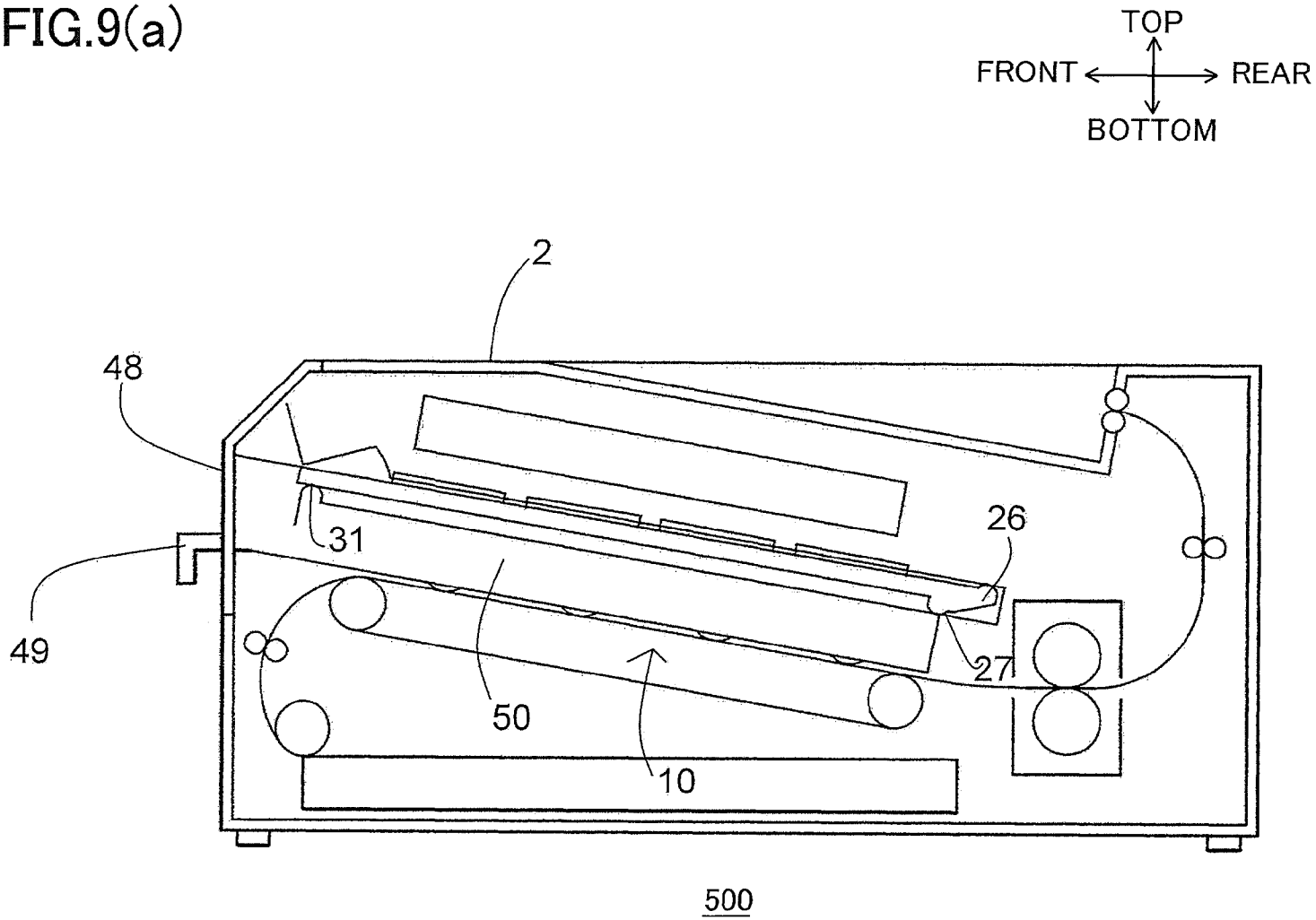
FIG. 9(*a*) is a schematic cross-sectional view showing a printer according to a sixth embodiment of the present invention when the cartridge support member is disposed in an internal position.
Figure 9B:
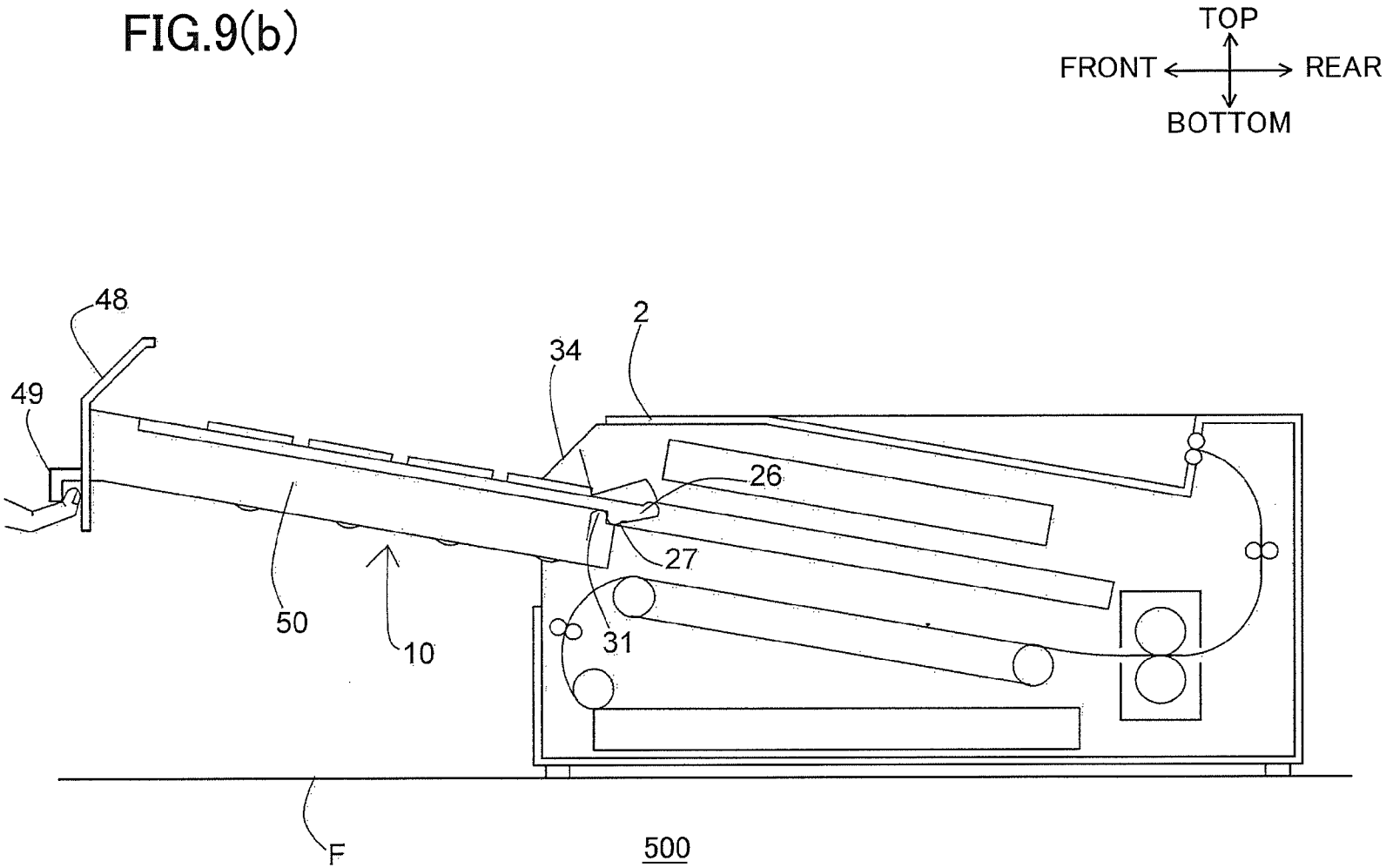
Figure 9C:
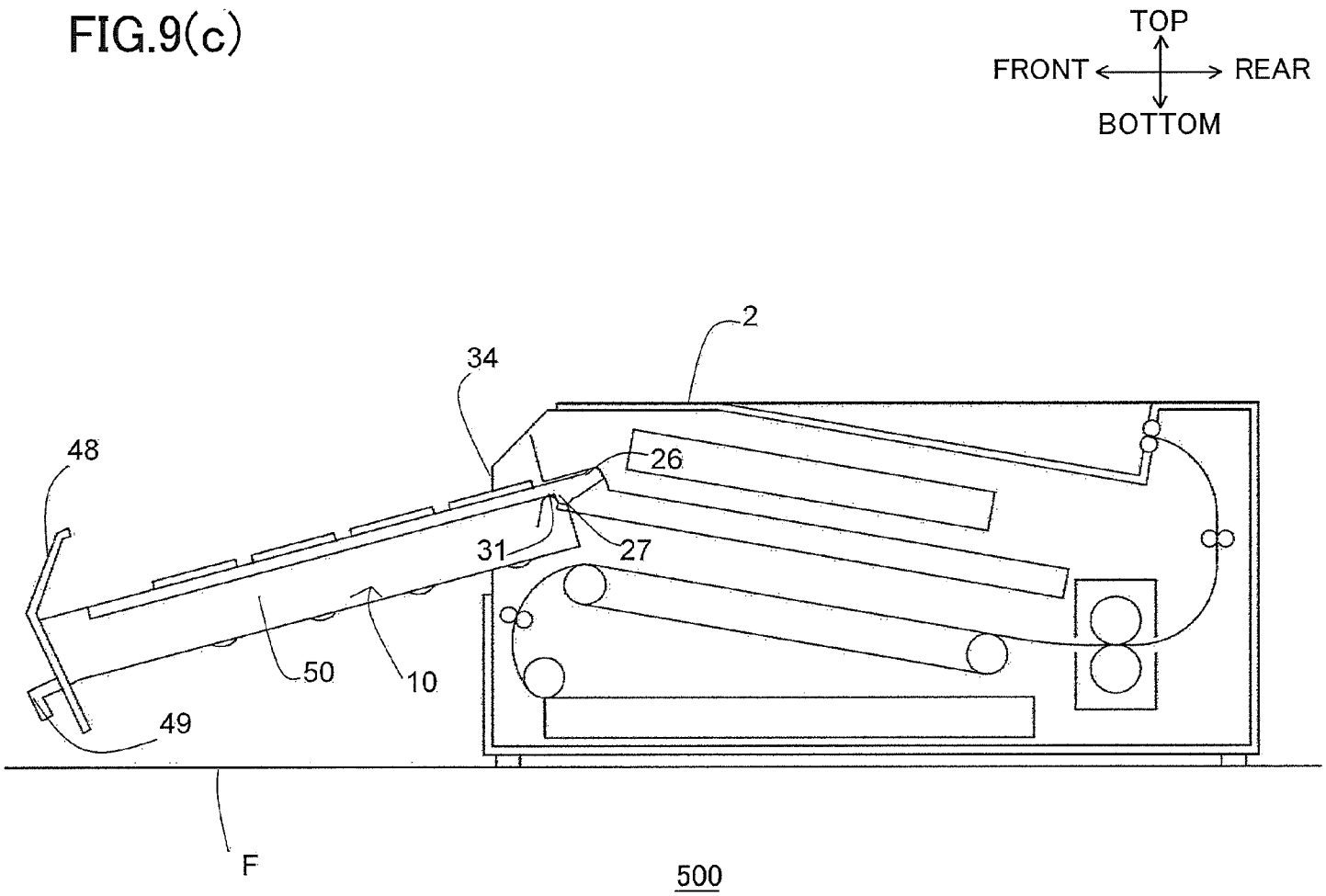
Figure 9D:
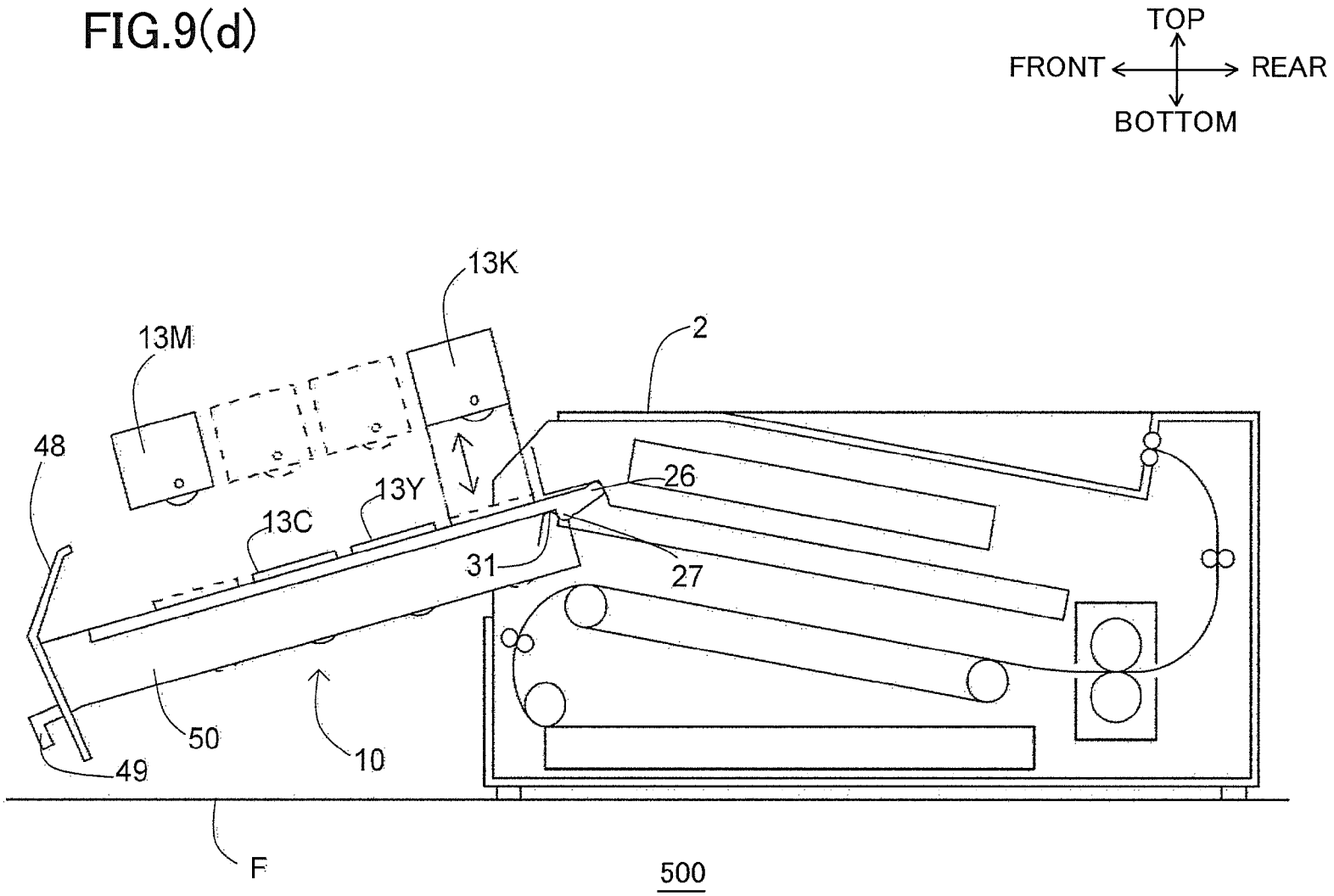

Next, a printer 400 according to a fifth embodiment will be described with reference to FIGS. 8(*a*) through 8(*c*). As shown in FIG. 8(*a*), the printer 400 is same as the printer 200 according to the third embodiment except that a cartridge support member part 47 is provided. In other words, the cartridge support member support part 47 is same as the cartridge support member support parts 46 except that the cartridge support member support part 47 is not formed on the lower guide surface 25B. The cartridge support member support part 47 is provided farther below and forward of the fulcrum part 31. The cartridge support member support part 47 is disposed near the paper-conveying belt 12 and is not connected to the fulcrum part 31. The cartridge support member support parts 47 function to support the cartridge support member 10 in its tilted state (i.e., in the cartridge mounting position).

FIG. 8(*b*) shows the state of the cartridge support member 10 slid out of the main casing 2 to the point that the second contact portions 27 of the cartridge support member 10 contact the fulcrum parts 31 and halt movement of the cartridge support member 10. At this time, the cartridge support member 10 is not in contact with the cartridge support member support parts 47. From this state, the operator pulls down on the front grip 23 of the cartridge support member 10, pivoting the front end of the cartridge support member 10 downward toward the installation surface F until the bottom edge of the cartridge housing case 22 contacts the cartridge support member support parts 47. This contact prevents the cartridge support member 10 from pivoting any further in the counterclockwise direction of FIG. 8(*c*) and supports the cartridge support member 10 in the tilted state shown in FIG. 8(*c*). Thus, the cartridge support member 10 is supported in its tilted state by the cartridge support member support parts 47 in addition to the receiving parts 39 and fulcrum parts 31.

Since rotation of the cartridge support member 10 is halted when the bottom edge of the cartridge support member 10 contacts the cartridge support member support parts 47, the inclination angle of the cartridge support member 10 when the cartridge support member 10 is supported in its tilted state can be adjusted by varying the vertical position of the cartridge support member support parts 47.

As described above, the cartridge support member support parts 47 are provided on the front side of the fulcrum parts 31 for supporting the cartridge support member 10 in the cartridge mounting position. Since the addition of the cartridge support member support parts 47 increases the number of parts supporting the cartridge support member 10 in the cartridge mounting position, this construction can support the cartridge support member 10 with greater stability.

A printer 500 according to sixth embodiment will be described with reference to FIGS. 9(*a*) and 9(*b*). In the printer 500 according to the sixth embodiment shown in FIG. 9(*a*), a front cover 48 is provided on the front side of the cartridge housing case 50, while the front cover 38 is provided on the main casing 2 in the first embodiment. The front cover 48 is integrally formed with a cartridge housing case 50 provided in the cartridge support member 10. Specifically, the front cover 48 is connected to the front end of the cartridge housing case 50. In other words, the cartridge housing case 50 has the front cover 48 covering the accesses opening 34 when the cartridge support member 10 is disposed in the internal position. A front grip 49 is provided on the front portion of the front cover 48.

To remove the cartridge support member 10 from the main casing 2 with the structure according to the sixth embodiment, first the operator grips the front grip 49 and pulls the front cover 48 outward. Since the front cover 48 is integrally formed with the cartridge housing case 50, the cartridge support member 10 is also pulled out from the main casing 2 at this time. The operator pulls the front grip 49 until the second contact portions 27 of the cartridge support member 10 contact the fulcrum parts 31, stopping the sliding of the cartridge support member 10. At this time, the cartridge support member 10 is in the external position shown in FIG. 9(*b*).

After the cartridge support member 10 has been pulled out of the main casing 2 to the external position, the operator pulls the front grip 49 of the cartridge support member 10 downward so that the front end of the cartridge support member 10 rotates toward the installation surface F. Through this operation, the cartridge support member 10 can be held in the tilted state shown in FIG. 9(*c*). With the cartridge support member 10 tilted in this way, the operator facing the printer 1 pulls the process cartridges 13 toward the operator, as shown in FIG. 9(*d*). In other words, tilting the cartridge support member 10 in this way makes it easier for the operator to remove the process cartridges 13 than when the cartridge support member 10 is not tilted, as in the state shown in FIG. 9(*b*).

As described above, the front cover 48 of the main casing 2 serving to cover the access opening 34 is integrally formed with the cartridge support member 10. This configuration facilitates maintenance since the operator can simply pull the cartridge support member 10 out of the main casing 2 without opening and closing the front cover 48.

While the invention has been described in detail with reference to the first through sixth embodiments thereof, it would be apparent to those skilled in the art that various changes and modifications may be made therein without departing from the spirit of the invention.

In the first through sixth embodiments, the guide parts 25, 125, 225, and 325 are sloped at about 10 degrees to the installation surface F, but the guide parts 25, 125, 225, and 325 may be inclined at any angle to the installation surface F between around 10 and 70 degrees.

While the surface of the guide part 39A in the third embodiment is formed of a felt-like material, this surface may be formed of any material having a high coefficient of friction, such as a rubber sheet.

What is claimed is:

1. An image forming device comprising a main casing providing a fulcrum part and having a front portion and a rear portion opposite the front portion in a horizontal direction; and a cartridge support member configured to support a plurality of cartridges and to be movable among an internal position in which the cartridge support member is accommodated in the main casing, an external position in which the cartridge support member is pulled outside the main casing through the front portion, and a cartridge mounting position, the cartridge support member being slidable in a pulled-out direction from the internal position to the external position, the cartridge support member being pivotable between the external position and the cartridge mounting position, the plurality of cartridges being arranged in a first predetermined direction, each of the plurality of cartridges including a photosensitive drum having an axis extending in an axial direction perpendicular to the first predetermined direction, the cartridge support member having an upstream portion and a downstream portion disposed downstream of the upstream portion in the first predetermined direction that is aligned with the pulled-out direction when the cartridge support member is disposed in the internal position, the cartridge support member pivoting about the fulcrum part positioned closer to the upstream portion than the downstream portion when the cartridge support member moves from the external position to the cartridge mounting position, wherein the main casing includes a guide part configured to support the cartridge support member and to guide movement of the cartridge support member between the internal position and the external position, the guide part including:

an upper guide surface extending in a direction parallel to the pulled-out direction; and a lower guide surface disposed below the upper guide surface and extending parallel to the upper guide surface, wherein the pulled out direction is a diagonal direction relative to and different than the horizontal direction, and the upper surface and the lower surface are sloped in the diagonal direction, and wherein the cartridge support member further has:

a front grip provided on the downstream portion;

a rear grip protruding from the upstream portion in a second predetermined direction perpendicular to both the first predetermined direction and the axial direction; and a contact part provided on the upstream portion and configured to contact the fulcrum part when the cartridge support member moves from the external position to the cartridge mounting position, the contact part and the rear grip being arranged in the second predetermined direction as viewed in the axial direction.

2. The image forming device according to claim 1, wherein the cartridge support member further includes a contact portion configured to contact the upper guide surface when the cartridge support member is disposed in the cartridge mounting position, thereby preventing the cartridge support member from moving upward; and wherein the contact part is disposed downstream of the contact portion in the pulled-out direction when the cartridge support member is disposed in the internal position, and is configured to contact the lower guide surface when the cartridge support member is disposed in the cartridge mounting position, thereby preventing the cartridge support member from moving downward.

3. The image forming device according to claim 2, wherein the fulcrum part protrudes upward from the lower guide surface, the cartridge support member pivoting about the fulcrum part by contacting the contact part to the fulcrum part when the cartridge support member moves from the external position to the cartridge mounting position;

wherein the upper guide surface has:

a linear part extending in a direction parallel to the pulled-out direction; and a receiving part disposed downstream of the linear part in the pulled-out direction and configured to receive the contact portion when the cartridge support member is disposed in the cartridge mounting position; and wherein a gap between the receiving part and the lower guide surface is greater than a gap between the linear part and the lower guide surface.

4. The image forming device according to claim 3, wherein the upper guide surface has a downstream end in the pulled-out direction; and wherein the receiving part includes:

a pivot-restricting part extending diagonally upward with respect to the lower guide surface from the downstream end of the upper guide surface, and configured to receive the contact portion when the cartridge support member is disposed in the cartridge mounting position; and a guiding part disposed upstream of the pivot-restricting part in the pulled-out direction and connected with the pivot-restricting part, the guiding part extending toward the pivot-restricting part and diagonally upward with respect to the lower guide surface, the guiding part being configured to guide movement of the contact portion toward the pivot-restricting part when the cartridge support member moves from the external position to the cartridge mounting position.

5. The image forming device according to claim 4, wherein the cartridge support member further includes:

a casing accommodating the plurality of cartridges therein and including a downstream end portion and an upstream end portion disposed upstream of the downstream end portion in the predetermined direction that is the pulled-out direction when the cartridge support member is disposed in the internal position; and a protruding part protruding from the casing in a direction away from the downstream end portion, the contact portion protruding upward from the protruding part, the contact part protruding downward from the protruding part.

6. The image forming device according to claim 5, wherein the cartridge support member is detachably mounted in the main casing.

7. The image forming device according to claim 6, wherein the pivot-restricting part has an upstream end and a downstream end disposed downstream of the upstream end in the pulled-out direction; and wherein the downstream end of the pivot-restricting part is disposed opposite to the lower guide surface with respect to an imaginary plane including the linear part.

8. The image forming device according to claim 4, wherein the guiding part has a friction coefficient higher than that of the linear part.

9. The image forming device according to claim 3, wherein the upper guide surface has a downstream end in the pulled-out direction; and wherein the receiving part includes:

a pivot-restricting part extending diagonally upward with respect to the lower guide surface from the downstream end of the upper guide surface, and configured to receive the contact portion when the cartridge support member is disposed in the cartridge mounting position, the pivot-restricting part having an urging unit urging the contact portion when the cartridge support member is pivotally moved from the external position to the cartridge mounting position.

10. The image forming device according to claim 9, wherein the urging unit includes:

a pivoting member having one end portion and another end portion about which the pivoting member being pivotable; and an urging member configured to urge the one end portion toward the first contact portion.

11. The image forming device according to claim 3, wherein the main casing further comprises a support part disposed downstream of the receiving part in the pulled-out direction, the support part being configured to support the cartridge support member when the cartridge support member is disposed in the cartridge mounting position.

12. The image forming device according to claim 1, wherein the main casing includes upstream feet and downstream feet disposed downstream of the upstream feet with respect to the pulled-out direction; and wherein the fulcrum part is disposed between the upstream feet and the downstream feet and closer to the downstream feet than to the upstream feet, as viewed from the above the main casing.

13. The image forming device according to claim 1, wherein the main casing has an opening through which the cartridge support member passes when the cartridge support member moves from the internal position to the external position; and wherein the cartridge support member has a cover part covering the opening when the cartridge support member is disposed in the internal position.

14. The image forming device according to claim 4, wherein the guiding part is formed of a material having a friction coefficient higher than a friction coefficient of the linear part.

15. The image forming device according to claim 2, wherein the contact portion has a semicircular shape protruding upward, and the contact part has a semicircular shape protruding downward.

16. The image forming device according to claim 3, wherein the receiving part is disposed above the fulcrum part so that the receiving part and the fulcrum part partially overlap each other when viewed from above.

* * * * *